US010383783B2

(12) United States Patent
Kan

(10) Patent No.: US 10,383,783 B2
(45) Date of Patent: Aug. 20, 2019

(54) FLAT-PACK CONTAINER

(71) Applicant: CR Designers, LLC, Richmond, CA (US)

(72) Inventor: Anthony Kan, Atlanta, GA (US)

(73) Assignee: CR Designers, LLC, Richmond, CA (US)

( * ) Notice: Subject to any disclaimer, the term of this patent is extended or adjusted under 35 U.S.C. 154(b) by 0 days.

(21) Appl. No.: 15/519,509

(22) PCT Filed: Oct. 15, 2015

(86) PCT No.: PCT/US2015/055795
§ 371 (c)(1),
(2) Date: Apr. 14, 2017

(87) PCT Pub. No.: WO2016/061388
PCT Pub. Date: Apr. 21, 2016

(65) Prior Publication Data

US 2017/0246067 A1 Aug. 31, 2017

Related U.S. Application Data

(60) Provisional application No. 62/064,519, filed on Oct. 16, 2014.

(51) Int. Cl.
*A61G 17/007* (2006.01)

(52) U.S. Cl.
CPC ..... *A61G 17/007* (2013.01); *A61G 17/0106* (2017.05)

(58) Field of Classification Search
CPC ..... A61G 17/004; A61G 17/007; A61G 17/0073; A61G 17/0106; A61G 17/0405; A61G 17/042; B65D 9/12; B65D 9/34
USPC ..... 27/2, 4, 19; 220/4.28; 217/12 R, 65
See application file for complete search history.

(56) References Cited

U.S. PATENT DOCUMENTS

| | | | | | |
|---|---|---|---|---|---|
| 1,837,249 | A * | 12/1931 | Barber | B65D 81/07 | 217/52 |
| 3,692,201 | A * | 9/1972 | Garduna | B65D 9/12 | 217/12 R |
| 5,212,842 | A * | 5/1993 | Glydon | A63H 33/04 | 428/44 |
| 2005/0071965 | A1* | 4/2005 | Leverett | A61G 17/00 | 27/20 |
| 2012/0042488 | A1* | 2/2012 | Hsu | A61G 17/0073 | 27/4 |
| 2012/0084952 | A1* | 4/2012 | Hobstetter | A61G 17/00 | 27/1 |

* cited by examiner

*Primary Examiner* — William L Miller
(74) *Attorney, Agent, or Firm* — Bekiares Eliezer LLP

(57) ABSTRACT

Embodiments of the present disclosure may comprise pieces necessary to assemble a container for a deceased individual. The pieces may fit together in such a way as to minimize storage footprint and transportation costs. The pieces may be comprised of different types of materials including, but not limited to and different wood grain colors, and different interior dressings. Embodiments of the present disclosure may incorporate designs for reasons such as style preference or religious symbols. Further, the design of the present disclosure may vary in shape and dimensions to accommodate differently-sized individuals. Embodiments of the present disclosure may be assembled quickly and without special tools.

13 Claims, 27 Drawing Sheets

700

800

1300

1400

1500

1700

1700

2300

FLAT-PACK CONTAINER

RELATED APPLICATION

Under provisions of 35 U.S.C. § 119(e), the Applicant claims the benefit of U.S. provisional application Ser. No. 62/064,519, filed on Oct. 16, 2014 which is incorporated herein by reference. It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure generally relates to containers for the deceased.

BACKGROUND

After death, bodies are often placed into containers for burial and cremation. A common method is to rent a casket for the funeral and subsequently, the individual is transported to a second container (often cardboard) for cremation or burial. The transition to the second container is often seen as impersonal and dispassionate, but burning or burying an expensive casket is expensive and wasteful.

BRIEF OVERVIEW

A flat-pack container for the deceased may be provided. This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

Containers are generally required for cremation. A common method is to rent a casket for the funeral and subsequently, the individual is transported to a container (often cardboard) for cremation. Embodiments of the present disclosure may be used for both the funeral and the subsequent cremation.

Embodiments of the present disclosure may comprise pieces necessary to assemble a container for a deceased individual. The pieces may fit together in such a way as to minimize storage footprint and transportation costs. The pieces may be comprised of different types of materials including, but not limited to and different wood grain colors, and different interior dressings.

Embodiments of the present disclosure may incorporate designs for reasons such as style preference or religious symbols. Further, the design of the present disclosure may vary in shape and dimensions to accommodate differently-sized individuals. Embodiments of the present disclosure may be assembled quickly and without special tools.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. Further, although dimensions are included in some of the drawings, the dimensions should be interpreted as potential embodiments, rather than limitations.

DETAILED DESCRIPTION

Figure 1:
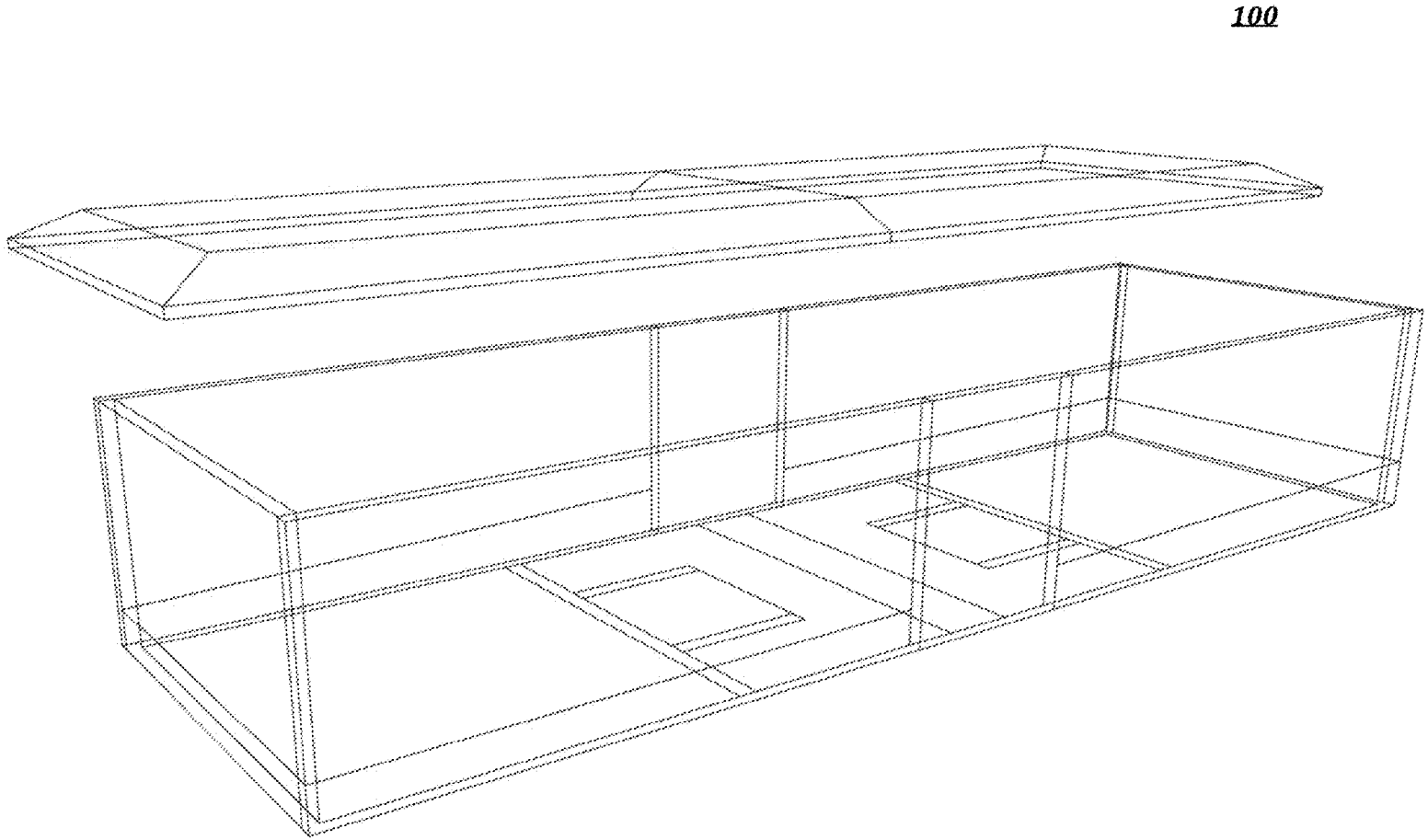
FIG. 1 illustrates a flat-pack container in an assembled form.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of human burial and cremation, embodiments of the present disclosure are not limited to use only in this context. For example, embodiments of the present disclosure may be used for burial and cremation of pets.

This disclosure relates to a container for the deceased. Uses for embodiments of the present disclosure include, but are not limited to a casket for cremation or a traditional casket, or in times of emergency, for example, during natural disasters. The container may be compact and lightweight for easy transportation and requiring minimum space for storage.

The flat-pack containers may be able to hold conventional remains under the proper usage and transportation requirements.

The containers may be shipped in a knocked-down flat pack form. Further, they may be designed and arranged for quick set up for use. Some embodiments of the present disclosure may require less 28% of the space needed by conventional caskets. The compact design may result in less expensive shipping and storing costs.

Assembly may not require tools. Further, certain embodiments of the present disclosure may be easily assembled by a trained technician in less than twelve minutes.

Embodiments of the present disclosure may be available in varying forms. For example, exteriors may include varying types of materials including different types of wood. Further, interior liners and colors may vary. In addition, containers may include personalization such as monogramming or incorporation of religious insignia preferences.

The container may be comprised of a chassis onto which a shell is attached. The container may utilize one or more center inter-locking (CIL) devices to interconnect parts. The CIL devices may be comprised of materials, such as, for example, hardwood or compressed wood fiber. Base molding may be comprised, for example, of plywood or medium-density fiberboard. Shell frames may be comprised of, for example, lightweight hardwood. The exterior may be comprised of, for example, matte wood veneer finished. It may be available in multiple types of materials (e.g. woods including ash, poplar, pine, oak, walnut, cherry, maple, mahogany, etc.). Further, the exterior may be finished in varying colors and tones.

The interior of the container may comprise a lining. The lining may include, for example, a pillow and a sheet. The lining may be available in one or more colors and styles. Further, the lining may be available in various materials, such as velvet, woven, rayon or linen. The lining may be held, in some embodiments, by hook-and-loop. For example, a piece of hook material may attach to the lining, while the loop may attach to the interior of the container.

As one example, a container may be shipped in a 13×25×39 inch packing size and weigh less than 65 pounds. The exemplary container may be comprised of 13-14 parts and measure 22×24×78 inches once in assembled form. The associated drawings demonstrate potential embodiments of the present disclosure. Further, the drawings demonstrate a method for packing and assembling an example container.

Figure 2:
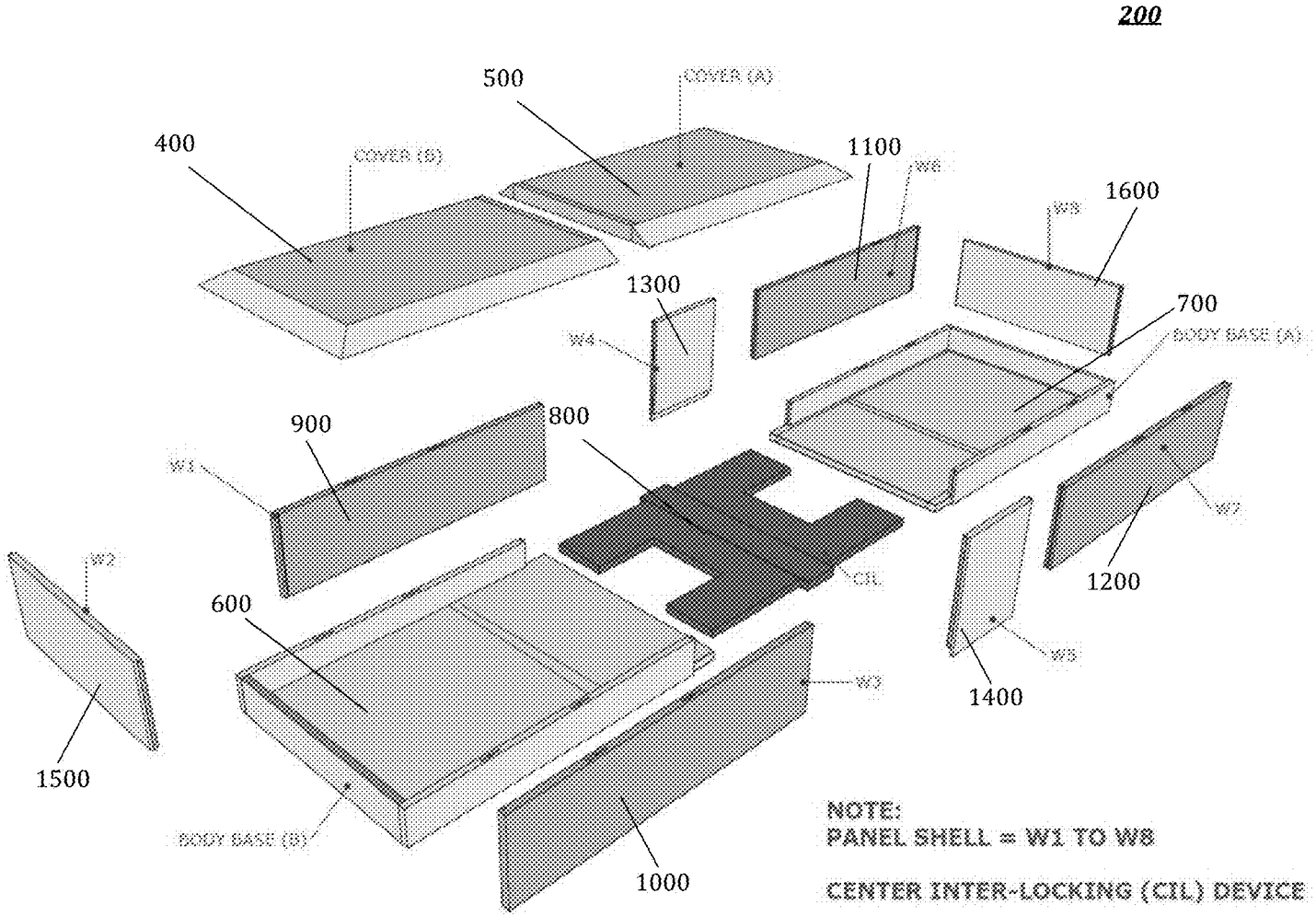
FIG. 2 illustrates an exploded view of the flat pack container.
Figure 3:
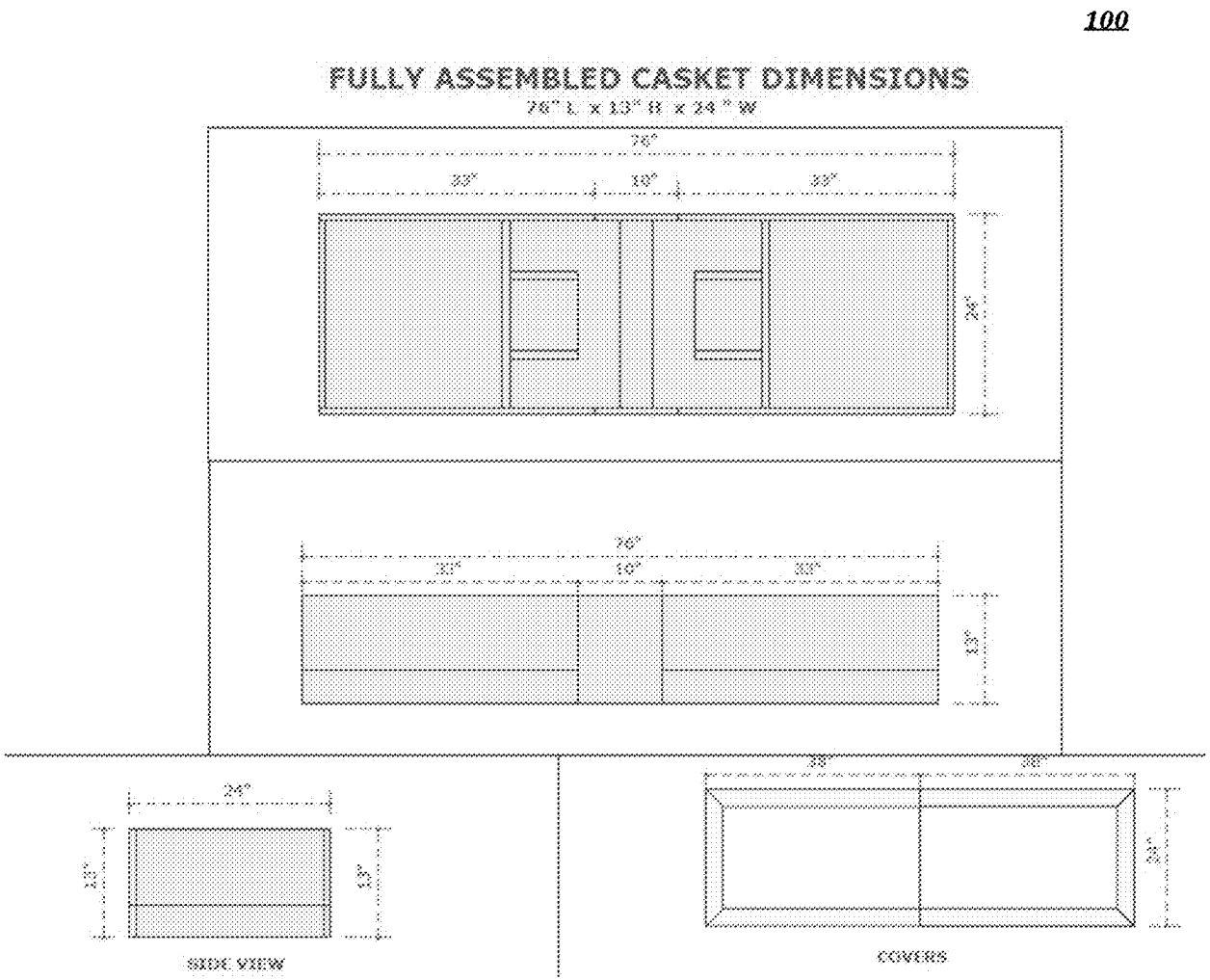
FIG. 3 illustrates a dimensioned view of an embodiment of the flat-pack container in the assembled form.
Figure 4:
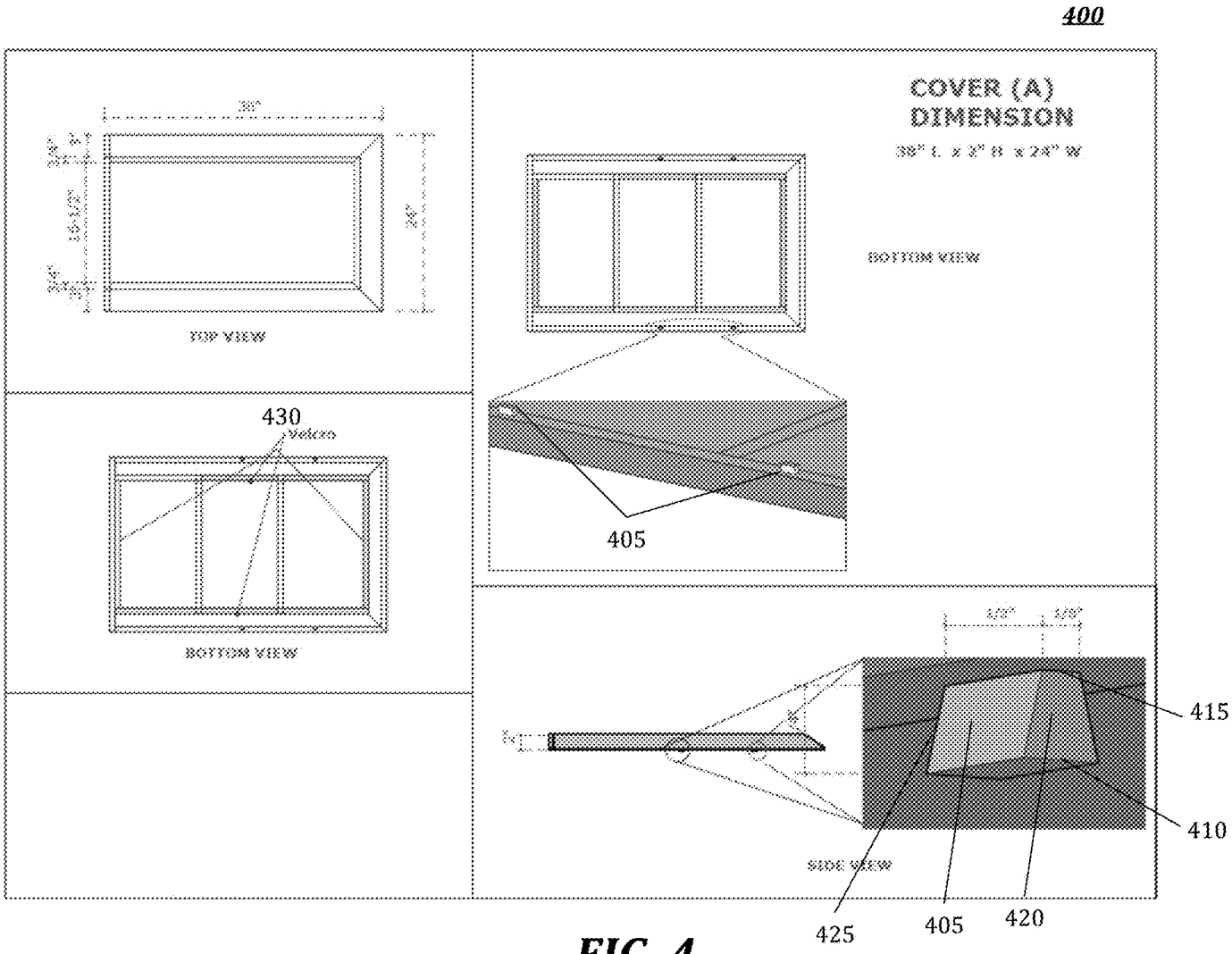
FIG. 4 illustrates a first cover section.
Figure 5:
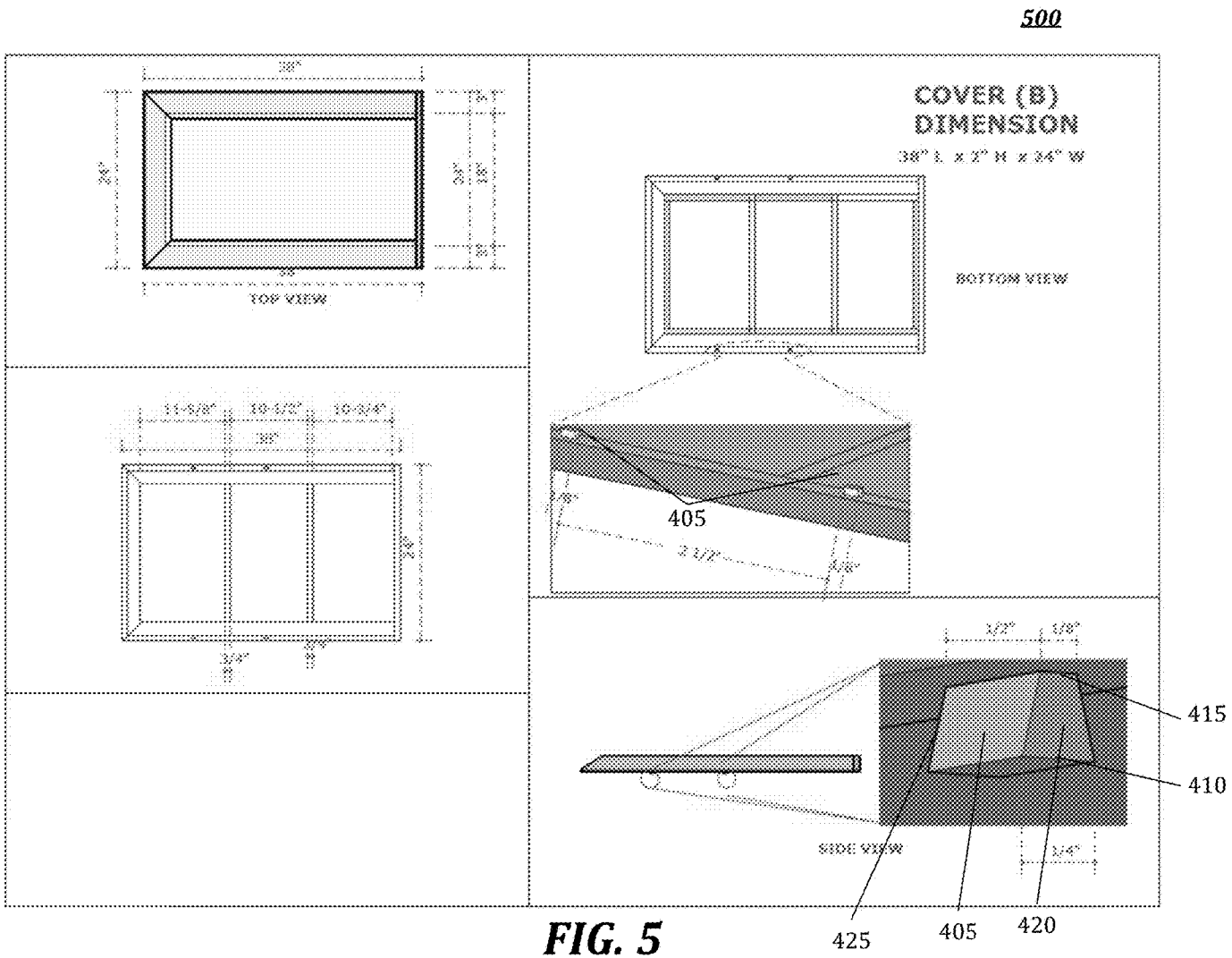
FIG. 5 illustrates a second cover section.

FIG. 1 illustrates a flat-pack container in an assembled form 100. FIG. 2 illustrates an exploded view 200 of a flat pack container. FIG. 3 illustrates a dimensioned view of an embodiment of the flat-pack container in the assembled form 100. FIG. 4 illustrates a first cover section 400. In some embodiments, first cover section 400 may comprise protrusions 405. Protrusions 405 may take a form comprising a wider side 410 and a narrower side 415. In this way, protrusions 405 may be configured to be inserted into a cutout (described below) for linking with a part comprising the cutout. For example, protrusions 405 may take a trapezoidal prism shape, as shown in the figures. In further embodiments, other shapes may be used, including, but not limited to, a 'T' profile, a "+" profile, etc. Protrusions 405 may further utilize a tapering profile from a front portion 420 to a back portion 425. In this way, protrusions 405 may lock as they are slid within the corresponding cutouts. FIG. 5 illustrates a second cover section 500. In some embodiments, second cover 500 may take a mirror image shape of first cover section 400. first cover section 400 and/or second cover section 500 may further comprise a means for holding material to each cover's corresponding underside, including, but not limited to hook-and-loop strips 430 (e.g., Velcro).

Figure 6A:
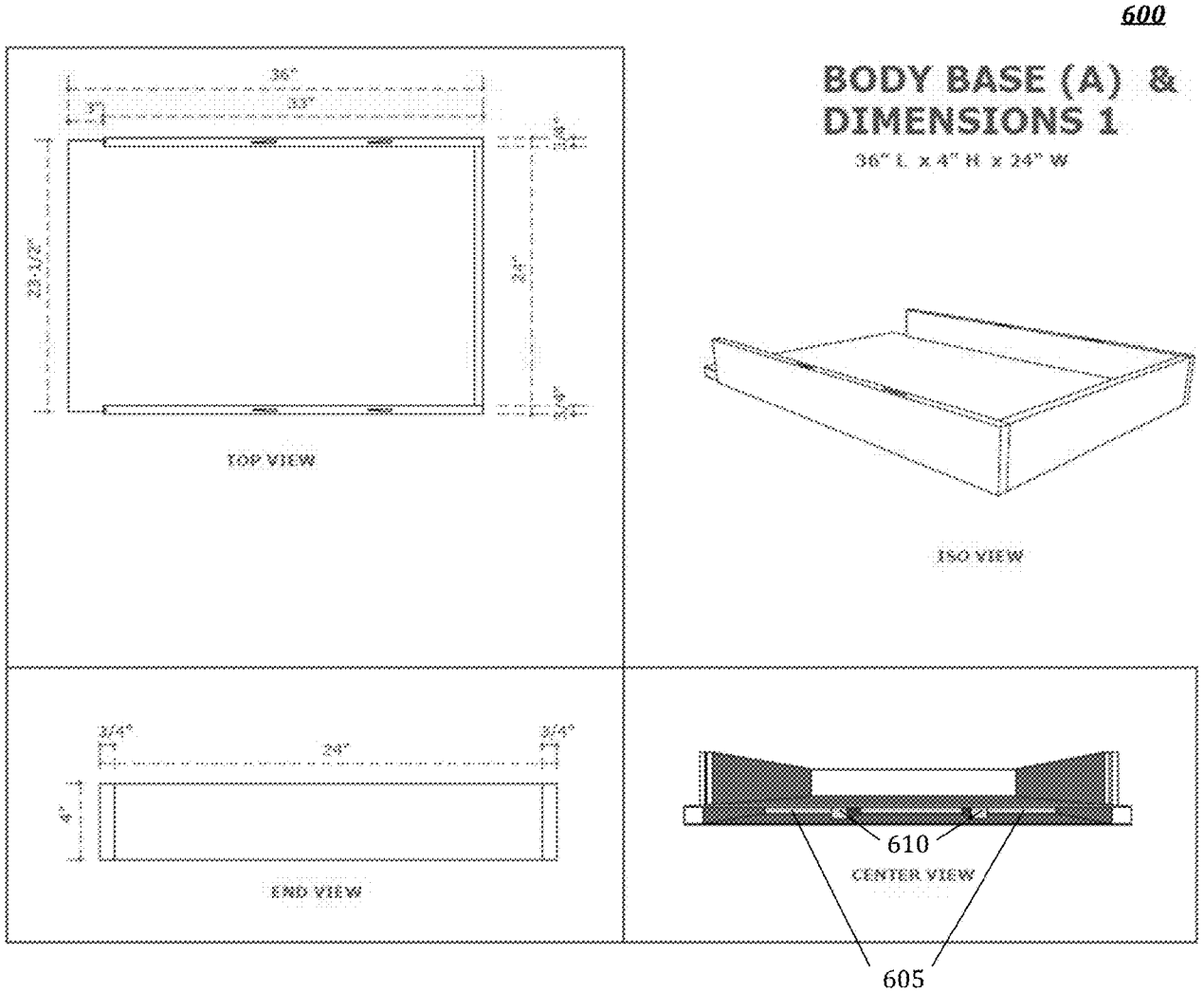
FIGS. 6A and 6B illustrate dimensions for a first body base.
Figure 6B:
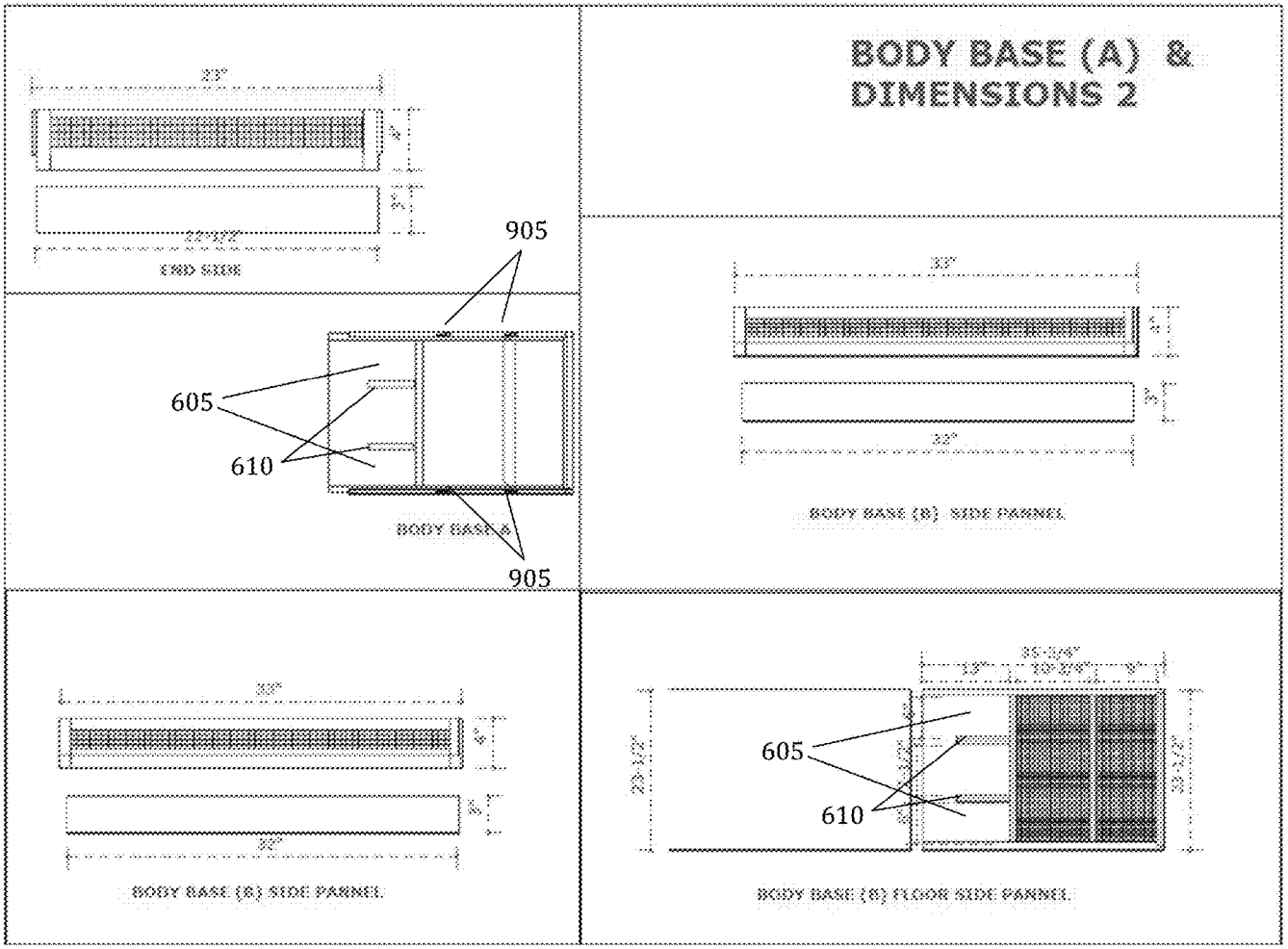
Figure 7A:
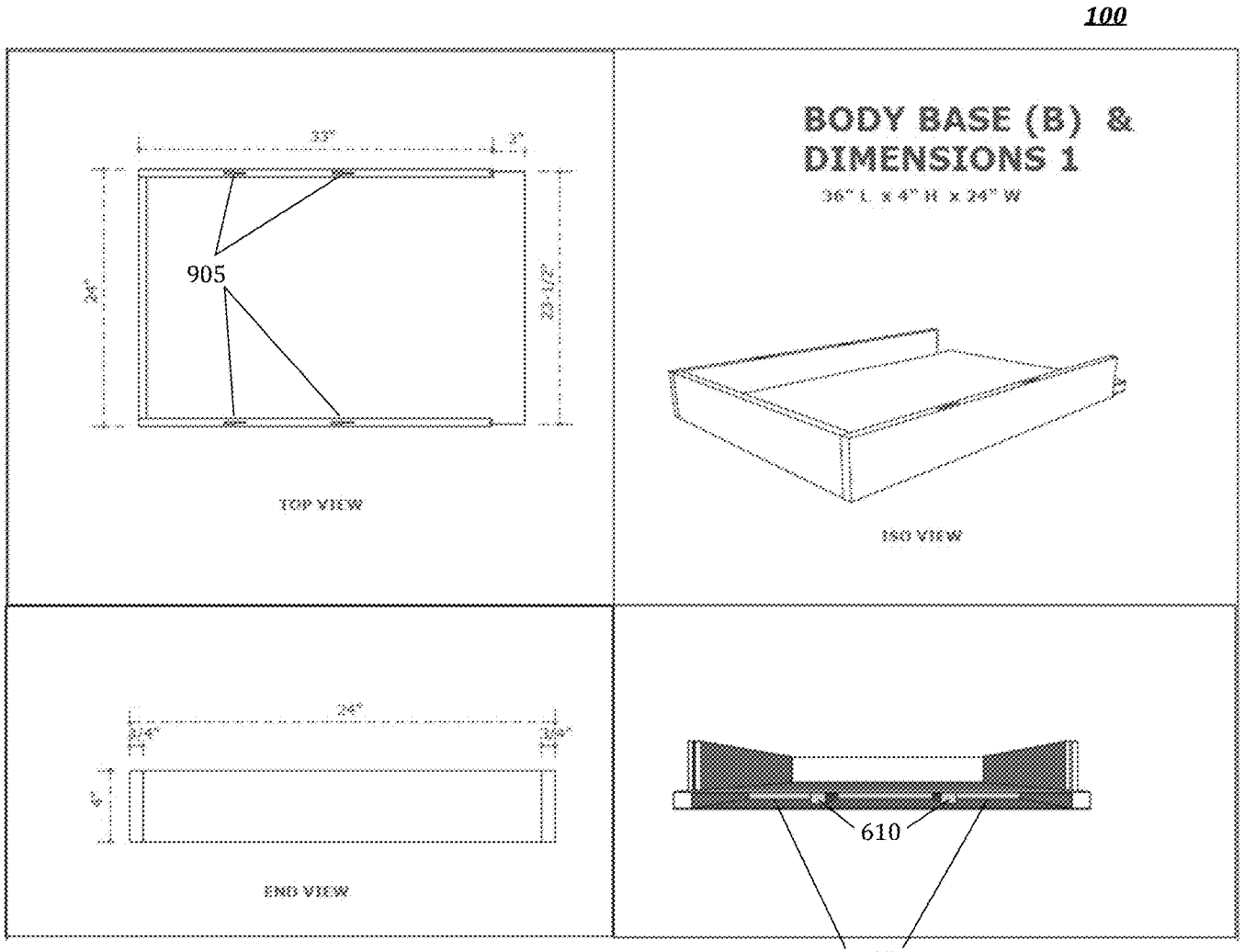
FIGS. 7A and 7B illustrate dimensions for a second body base.
Figure 7B:
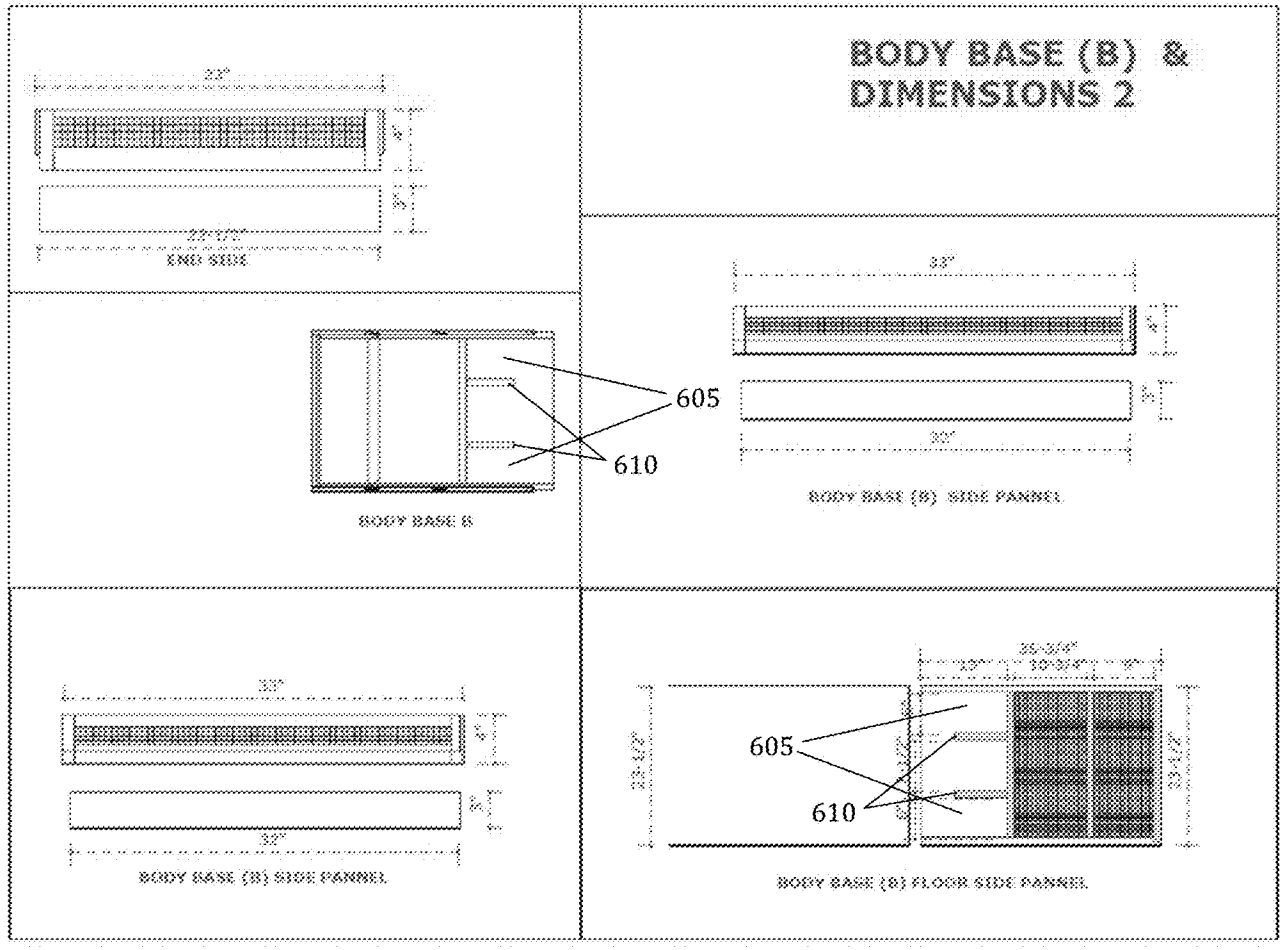

FIGS. 6A and 6B illustrate dimensions for a first body base 600 consistent with embodiments of the present disclosure. FIGS. 7A and 7B illustrate dimensions for a second body base 700 consistent with embodiments of the present disclosure. In some embodiments, second body base 700 may be a mirror image or an identical copy of first body base 600. First body base 600 and second body base 700 may comprise the cutouts configured to receive protrusions 405, as further illustrated with respect to FIG. 9. Further, first body base 600 and second body base 700 may comprise slots 705 for inserting a center inter-locking (CIL) device. Slots 605 may use spacers 610 for further securing the CIL device.

Figure 8:
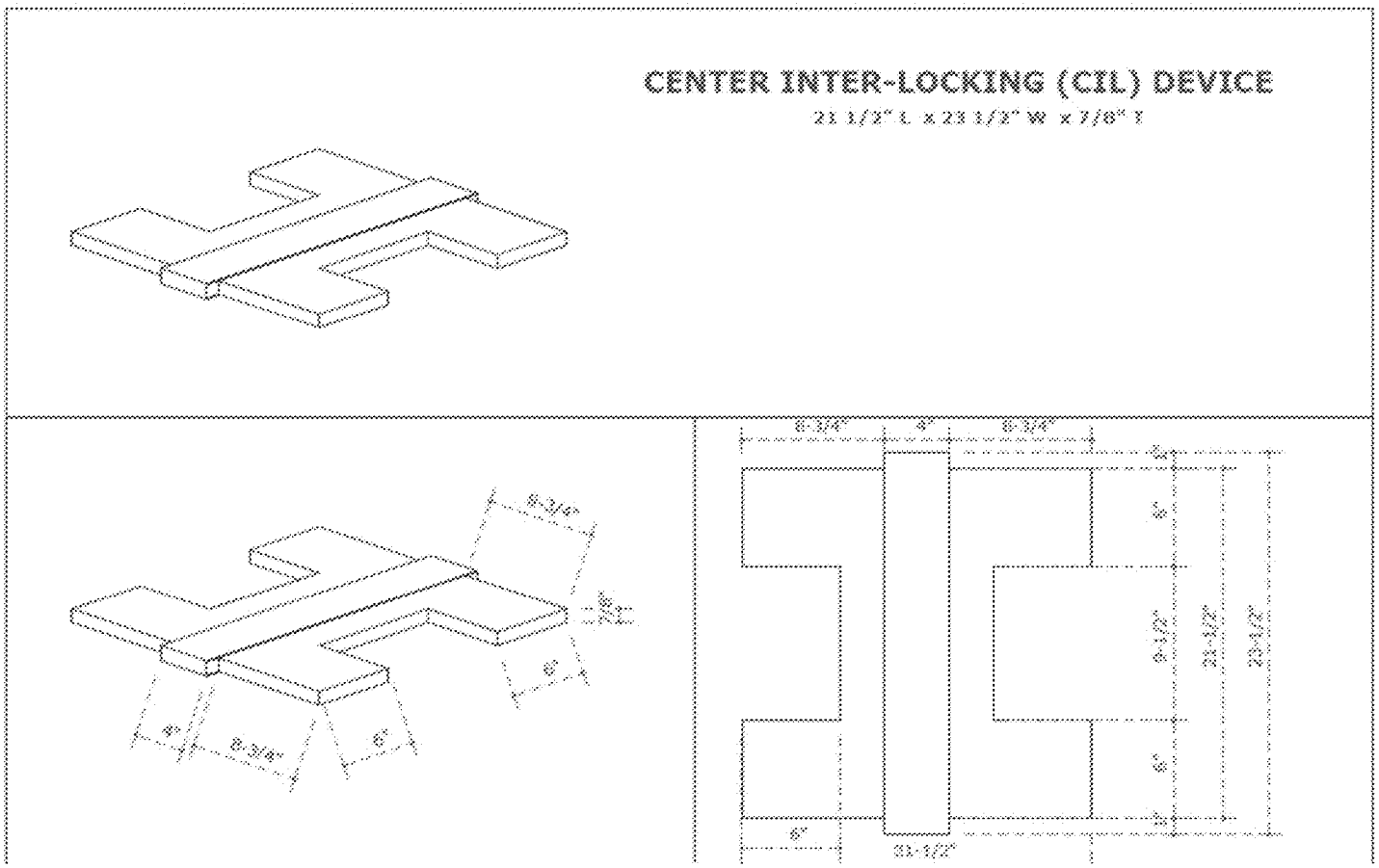
FIG. 8 illustrates a center inter-locking device.

FIG. 8 illustrates a CIL device 800. CIL device 100 may be configured to fit snugly within slots 605.

Figure 9:
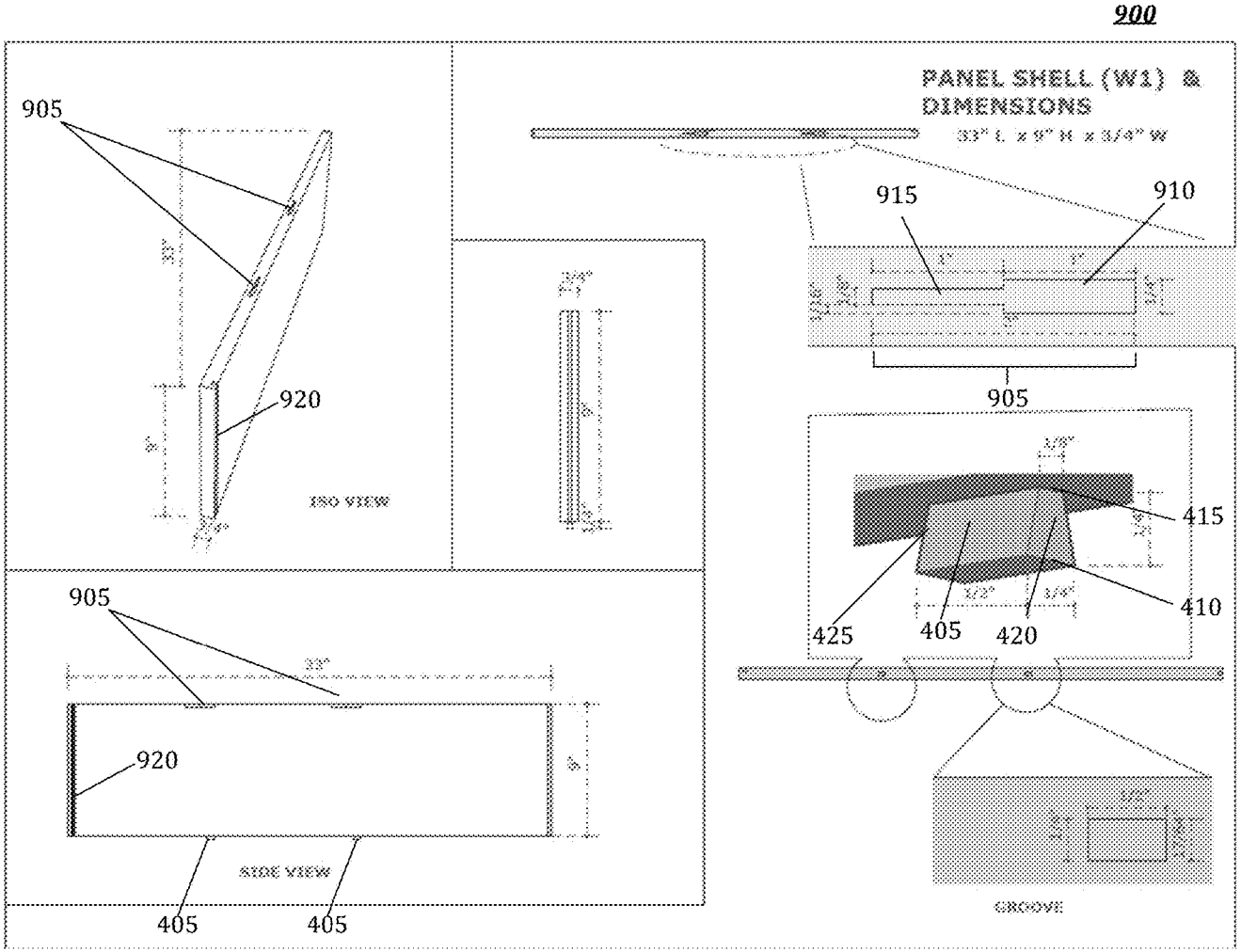
FIG. 9 illustrates a panel shell.
Figure 10:
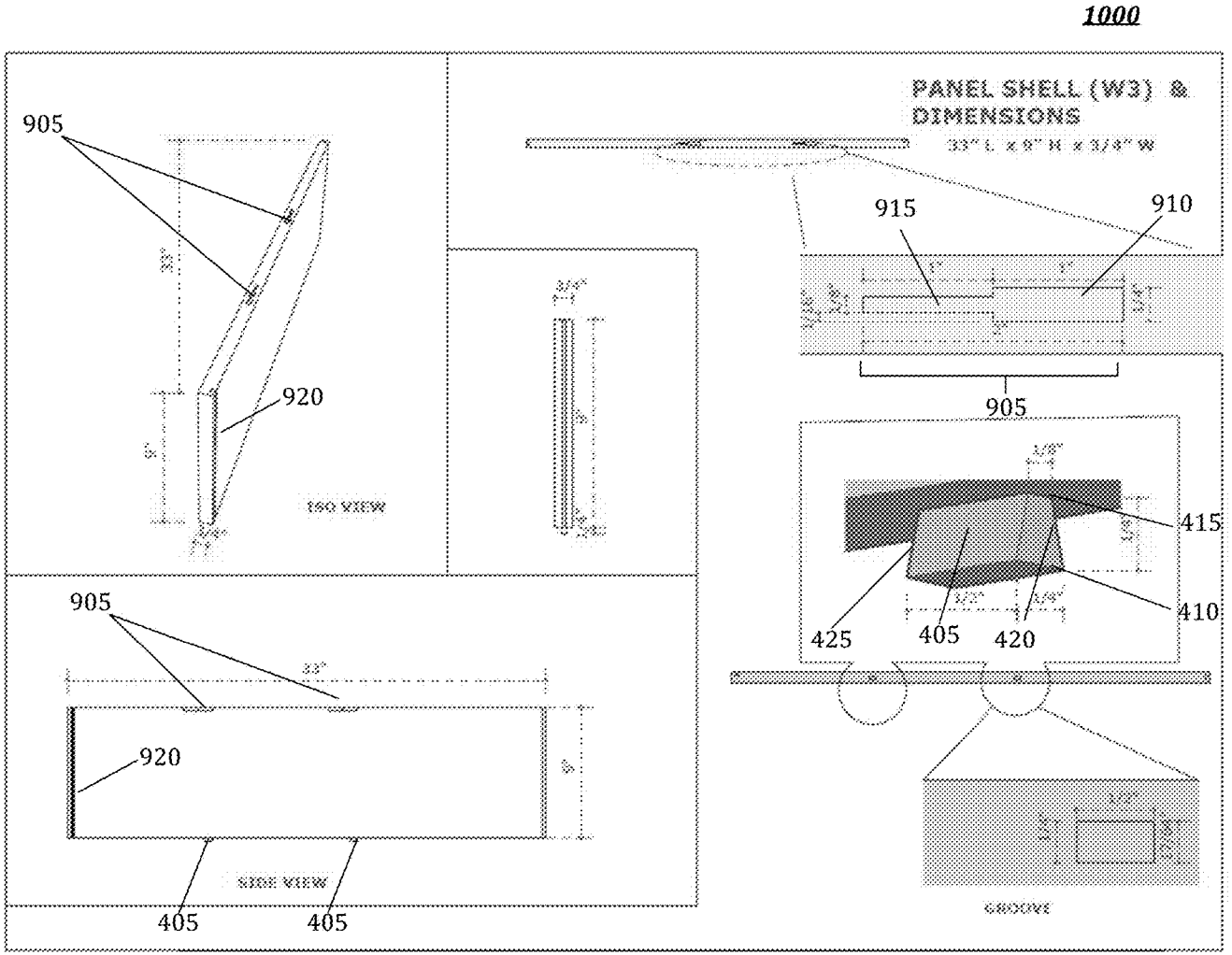
FIG. 10 illustrates a second panel shell.
Figure 11:
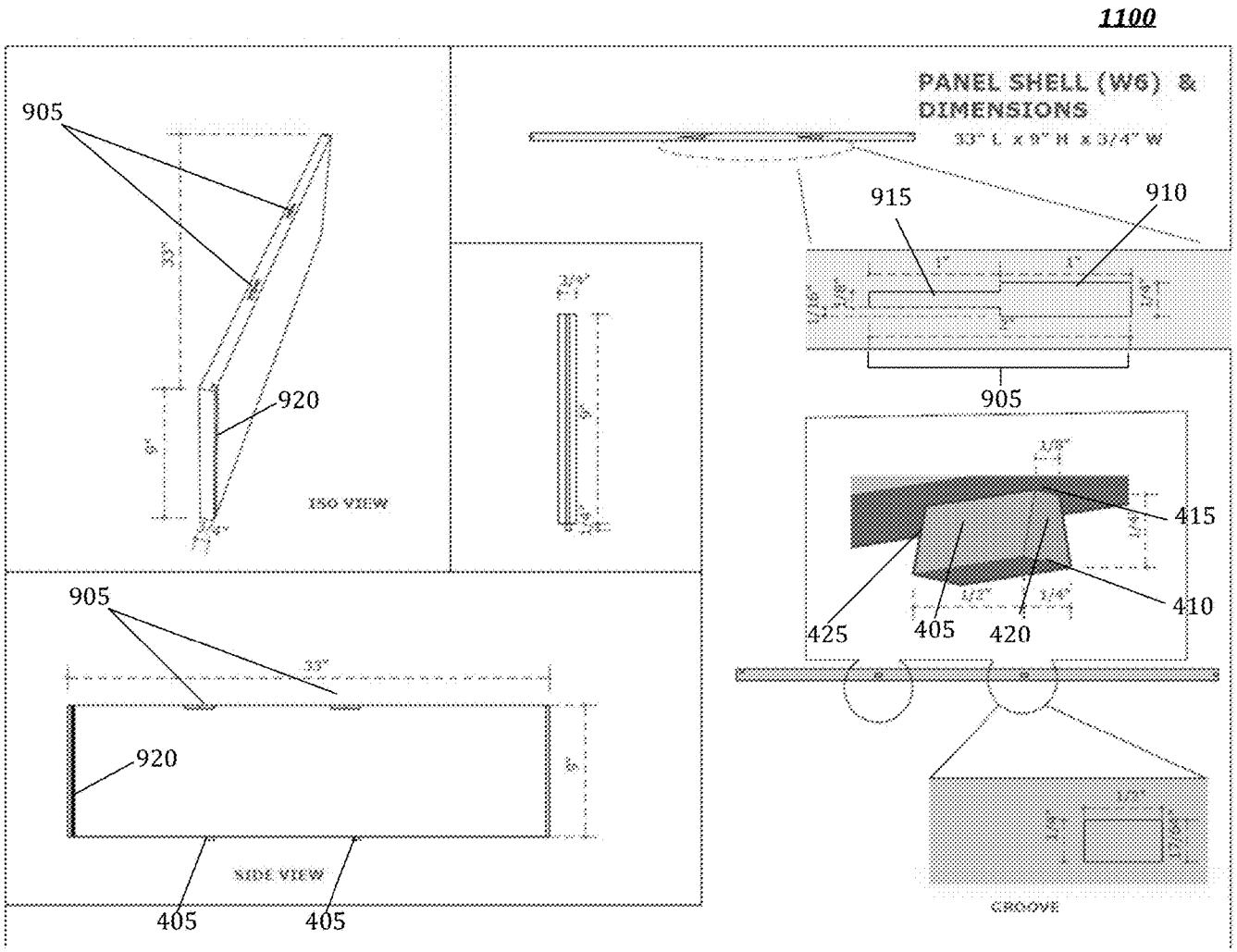
FIG. 11 illustrates a third panel shell.
Figure 12:
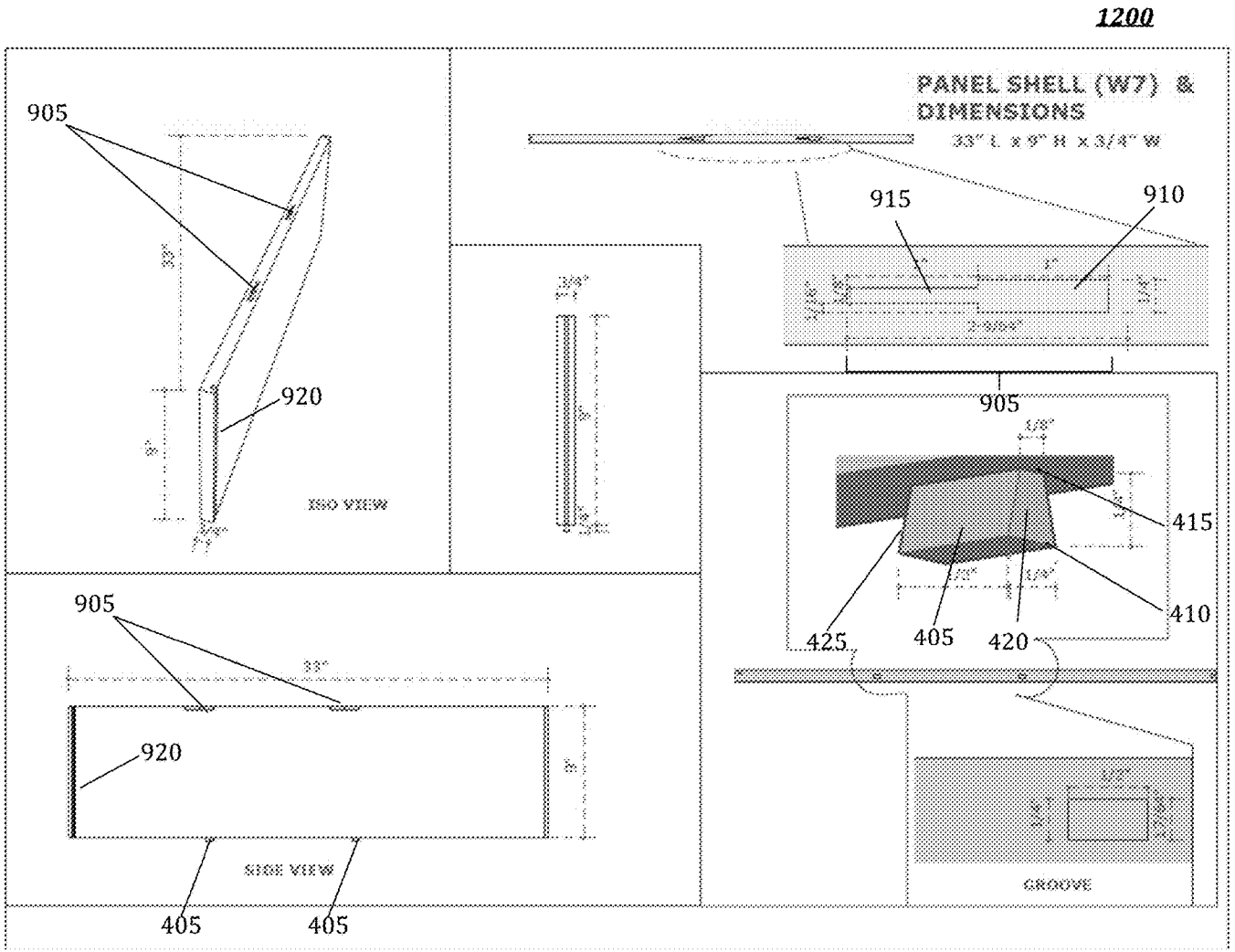
FIG. 12 illustrates a fourth panel shell.

FIG. 9 illustrates a panel shell 900. In some embodiments, panel shell 900 may comprise cutouts 905. Cutouts 905 may comprise a wide section 910 and a narrow section 915. In this way, cutouts 905 may receive protrusions 405 from the wider side 410. Protrusions 405 may then be slid within narrow section 915 such that wider side 410 cannot directly pull out. Panel shell 900 may further comprise cut outs 920 for receiving protrusions 1305, the latter of which are further illustrated in FIG. 13. FIGS. 10, 11, and 12 illustrate a panel shell 1000, a panel shell 1100, and a panel shell 1200, respectively. In some embodiments, panel shell 1000, a panel shell 1100, and a panel shell 1200 may be identical to panel shell 900.

Figure 13:
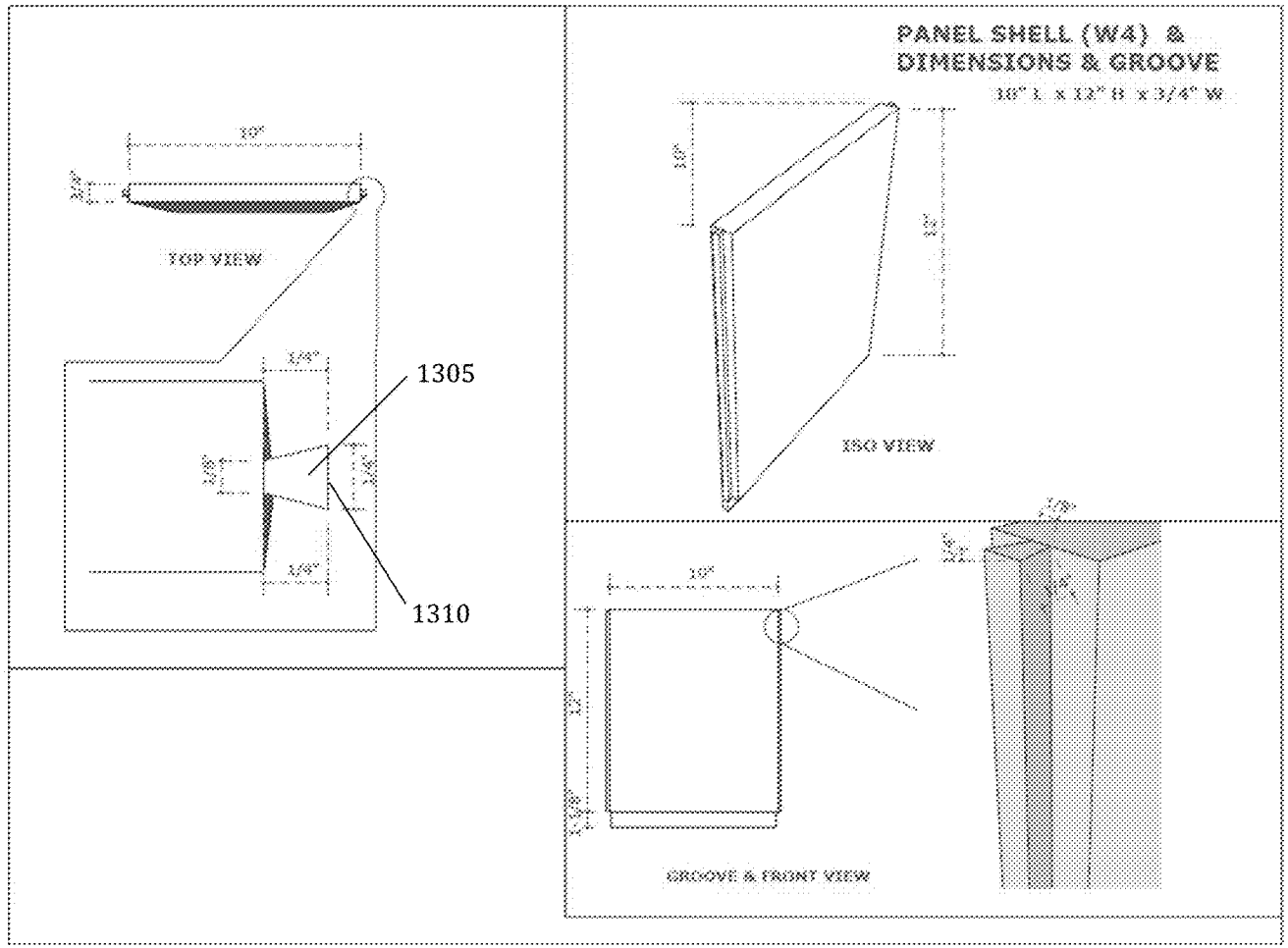
FIG. 13 illustrates a fifth panel shell.
Figure 14:
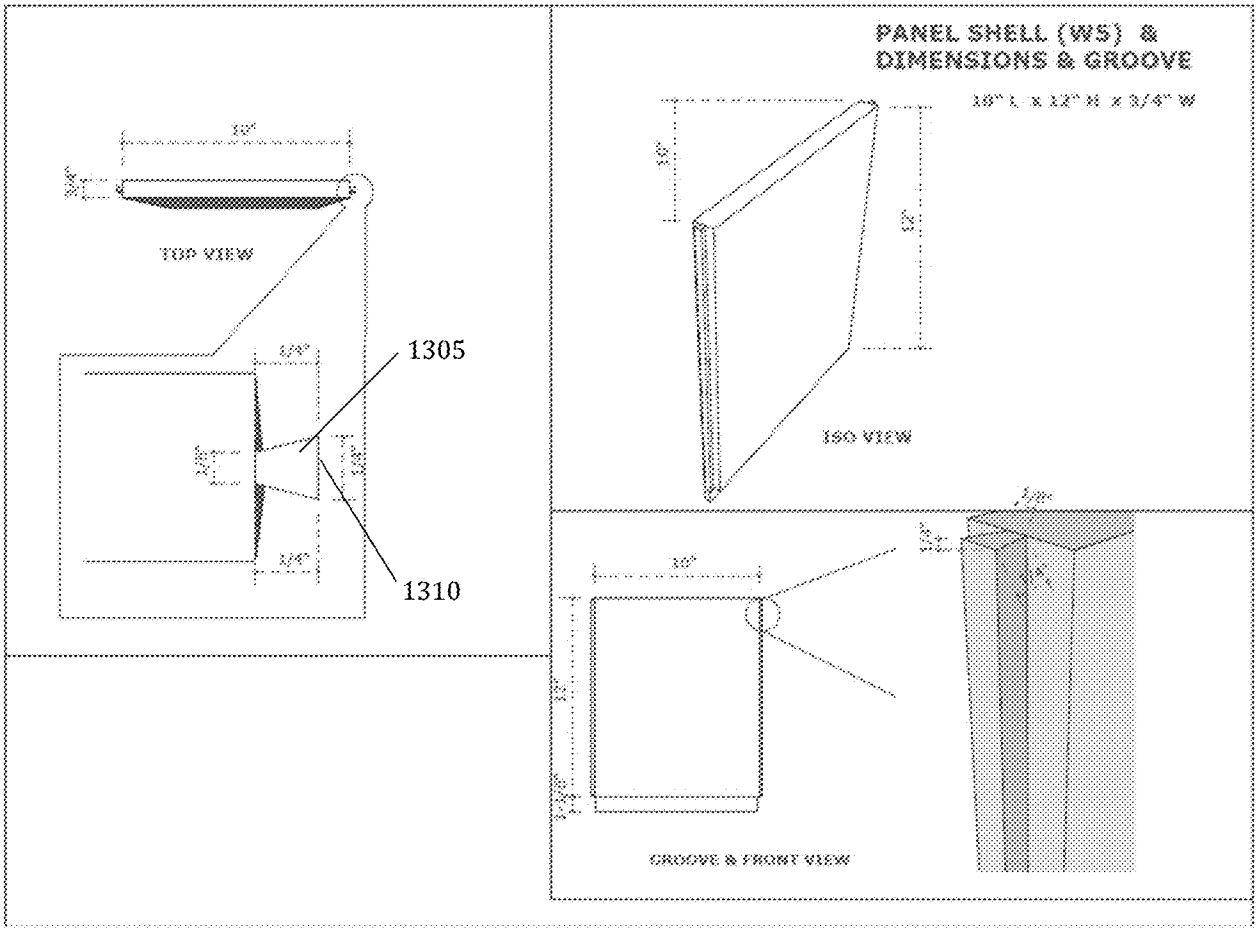
FIG. 14 illustrates a sixth panel shell.

FIG. 13 illustrates a panel shell 1300. Panel shell 1300 may comprise protrusions 1305 to mate with cutouts 905. As with protrusions 405, extrusions 1305 may comprise a wide side 1310 configured to lock within cutouts 905 to prevent a pulling out of cutouts 905. FIG. 14 illustrates a panel shell 1400, which, in some embodiments, may be identical to panel shell 1300.

Figure 15:
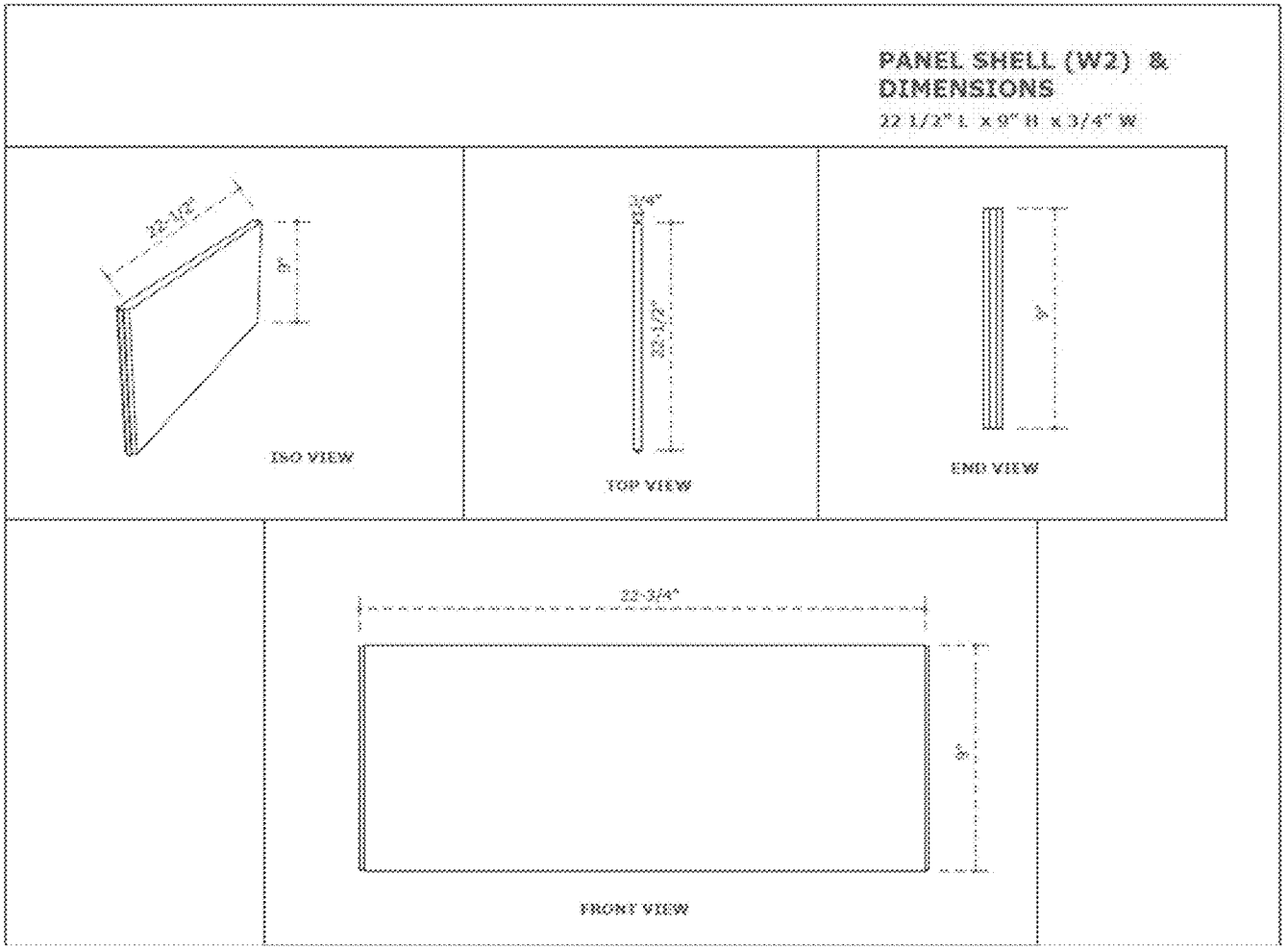
FIG. 15 illustrate a seventh panel shell.
Figure 16:
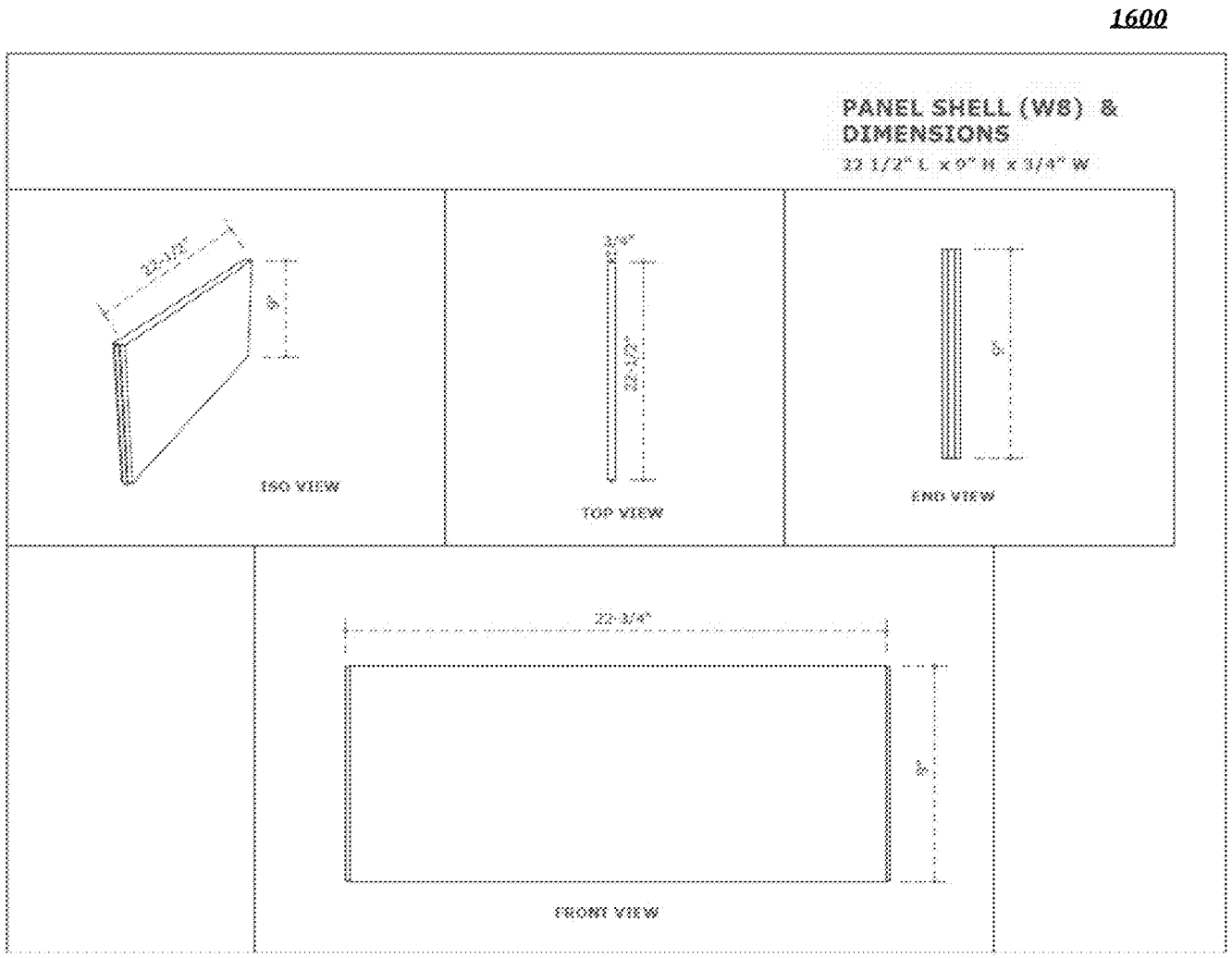
FIG. 16 illustrate an eighth panel shell.

FIGS. 15 and 16 illustrate a panel shell 1500, and a panel shell 1600, respectively. In some embodiments, panel shells 1500 and 1600 may be identical. Panel shells 1500 and 1600 may comprise extrusions identical or similar to protrusions 1305 for mating.

Though some parts are described as configured with protrusions while mating parts are described as configured with cutouts to receive the protrusions, it should be understood that the corresponding protrusions and cutouts may be interchanged between mating parts. Further, embodiments may not be limited to attachment by protrusions and corresponding cutouts. For example, some parts may be glued, while other parts may be locked by using press-fit dowels in properly-sized holes.

Figure 17A:
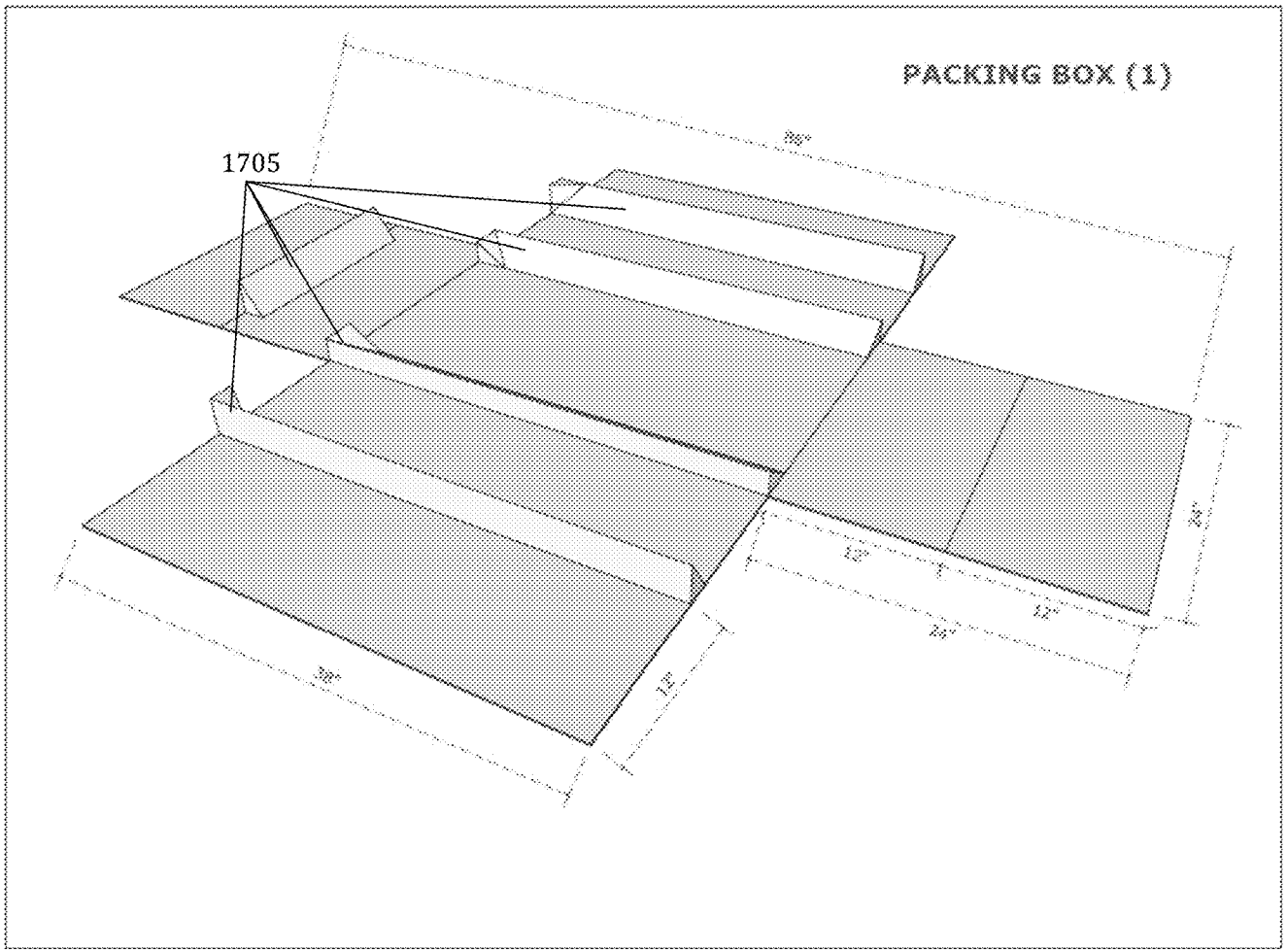
FIG. 17A illustrates a packing box in an unfolded configuration.
Figure 17B:
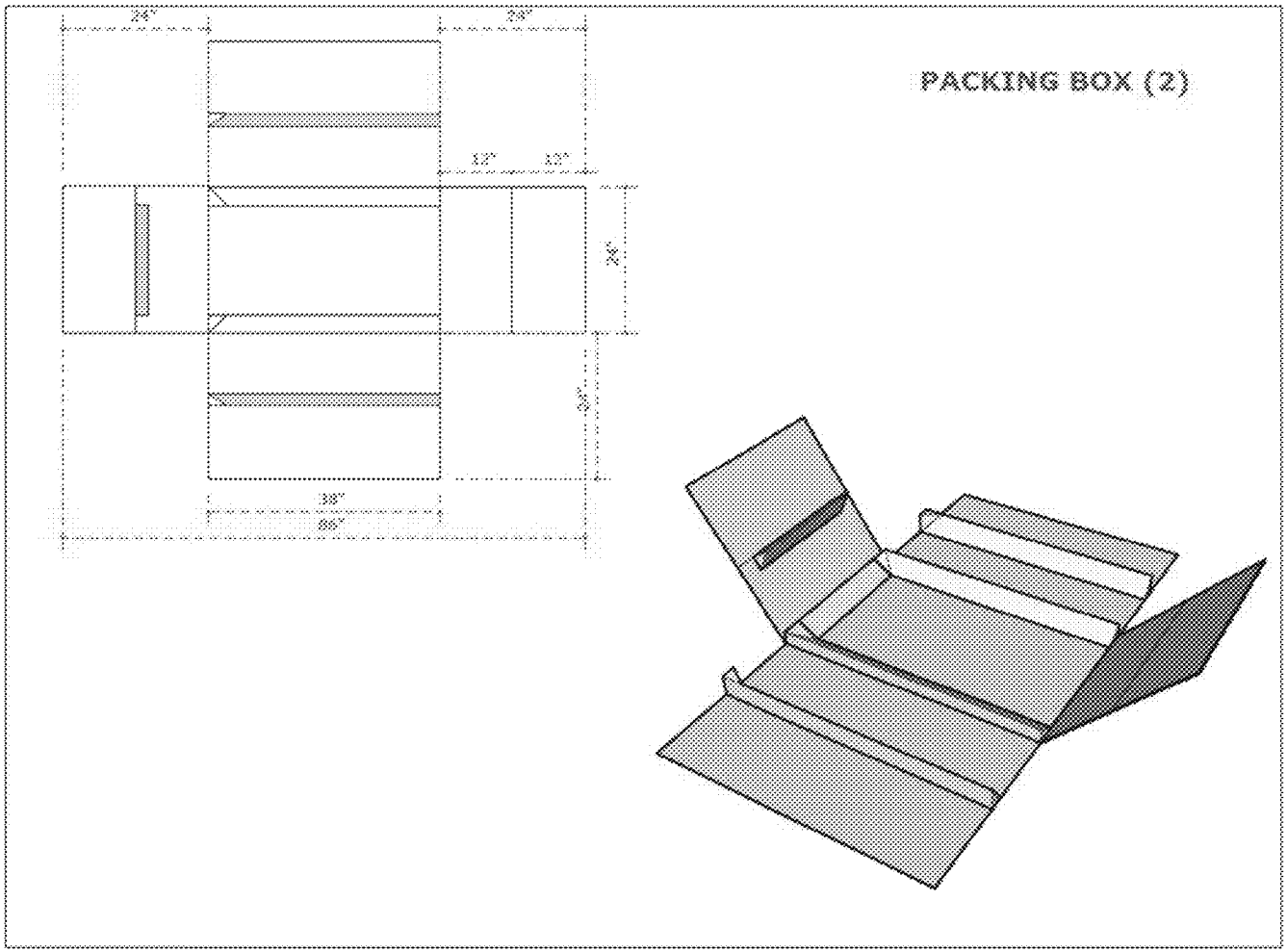
FIG. 17B illustrates the packing box in a partially folded configuration.
Figure 17C:
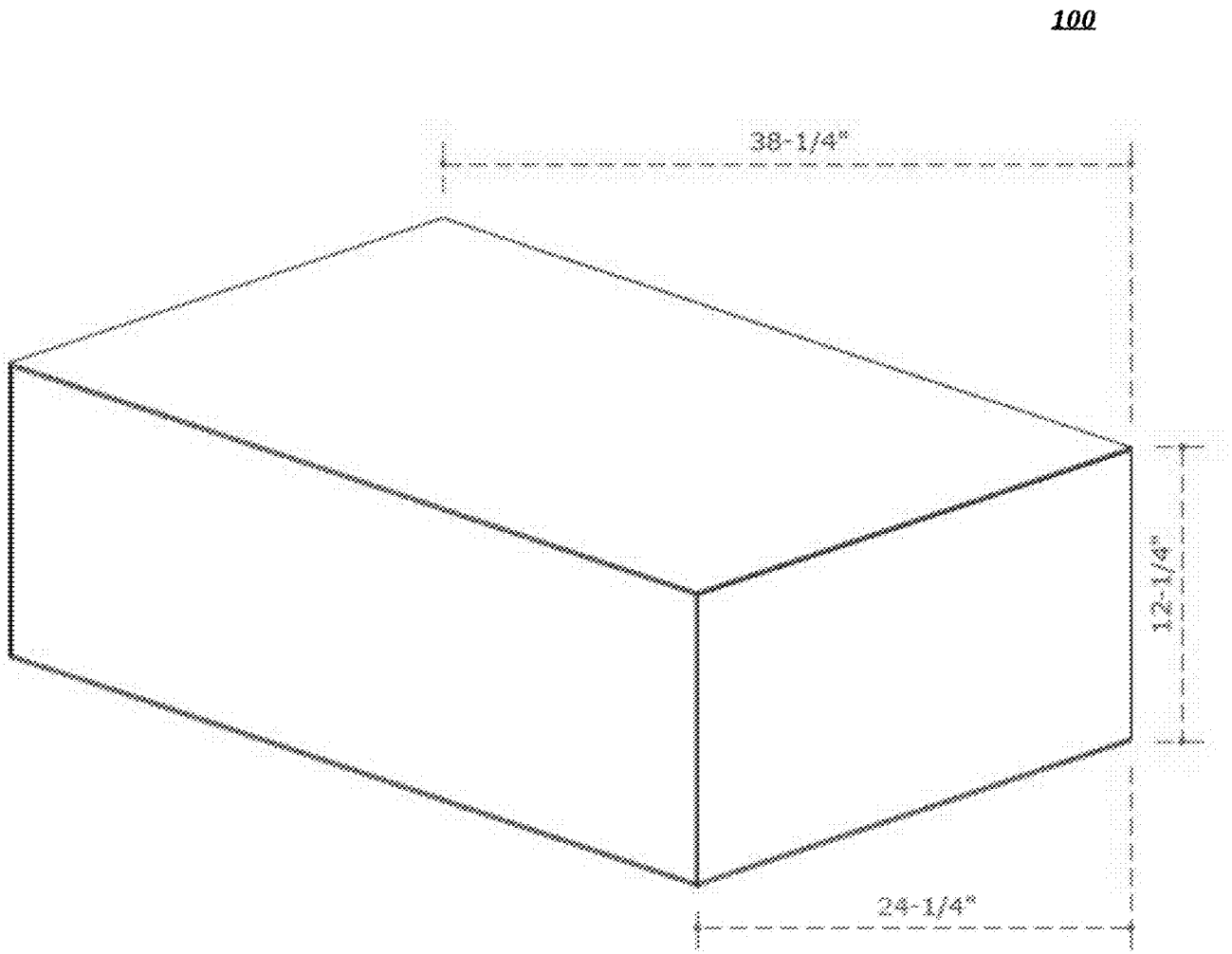
FIG. 17C illustrates the packing box in a completely packed form configuration.
Figure 18:
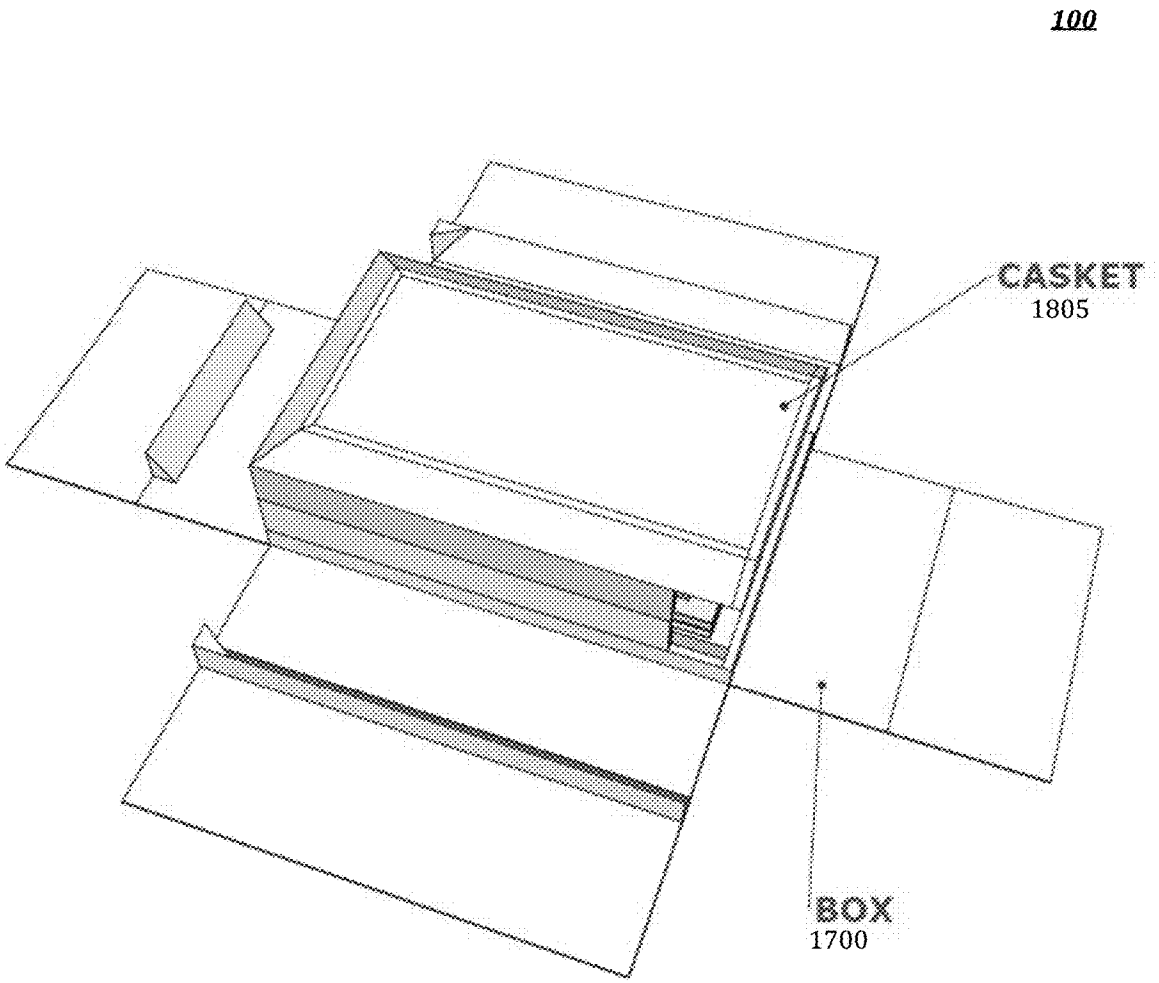
FIG. 18 illustrates a disassembled casket 1805 within packing box 1700 in an unfolded configuration.

FIG. 17A illustrates a packing box 1700 in an unfolded configuration. Supports 1705 may hold the flat-pack container in place, and may fit snugly against bevels in first cover section 400 and second cover section 500. FIG. 17B illustrates packing box 1700 in a partially folded configuration, and FIG. 17C illustrates packing box 1700 in a completely folded configuration. FIG. 18 illustrates a disassembled casket 1805 within packing box 1700 in an unfolded configuration.

Figure 19:
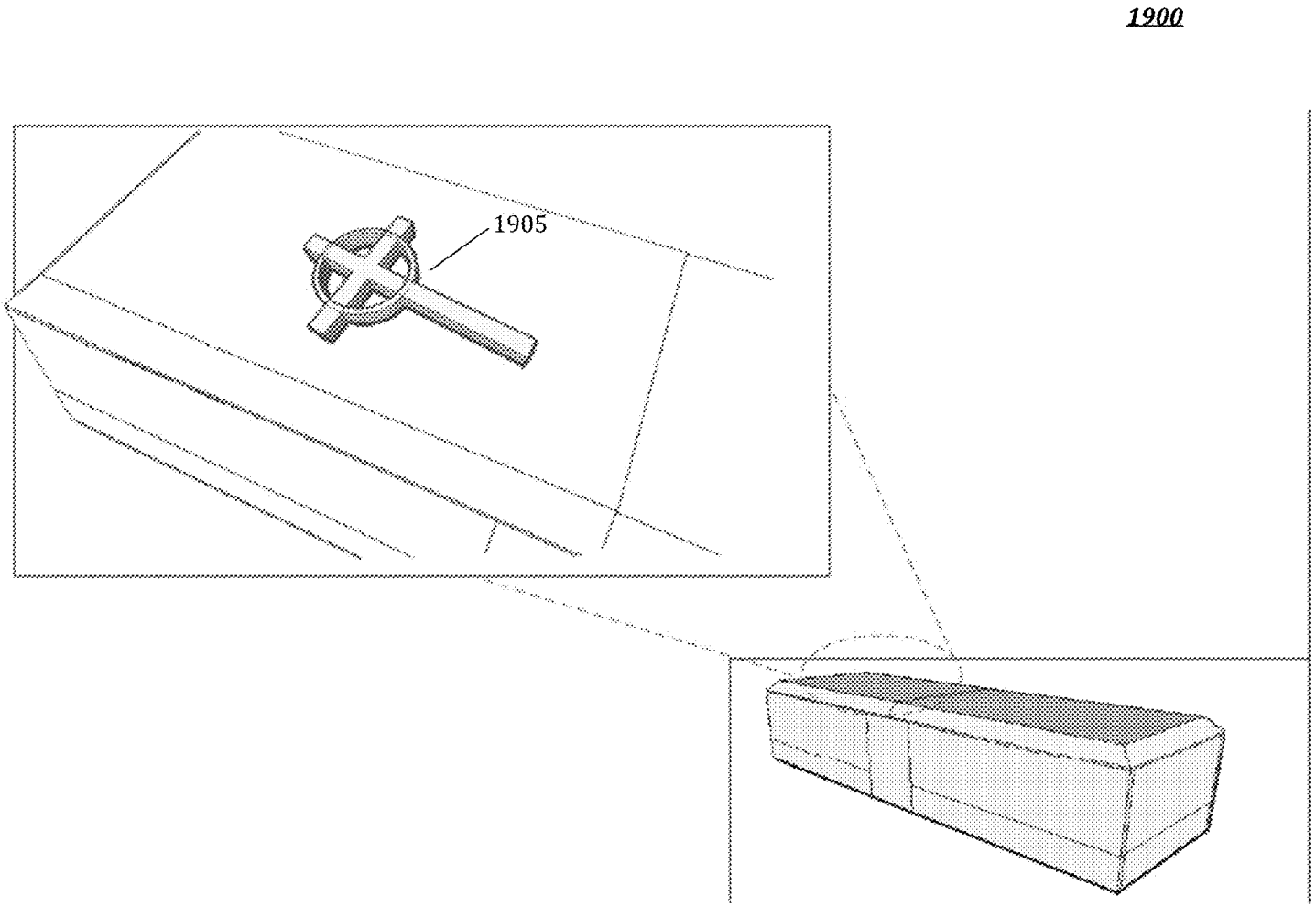
FIG. 19 illustrates a container comprising a cross.
Figure 20:
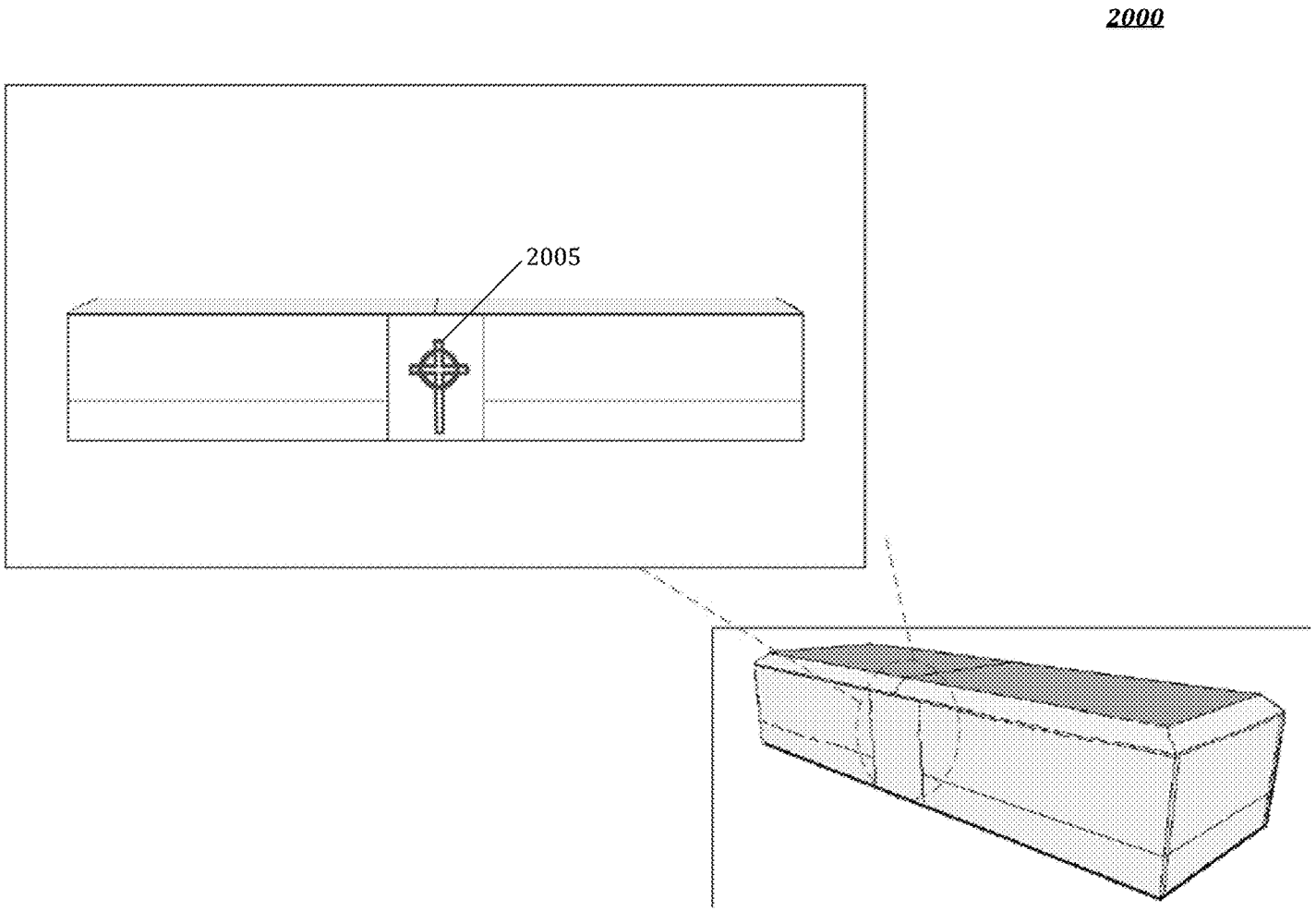
FIG. 20 illustrates another container comprising a cross.
Figure 21:
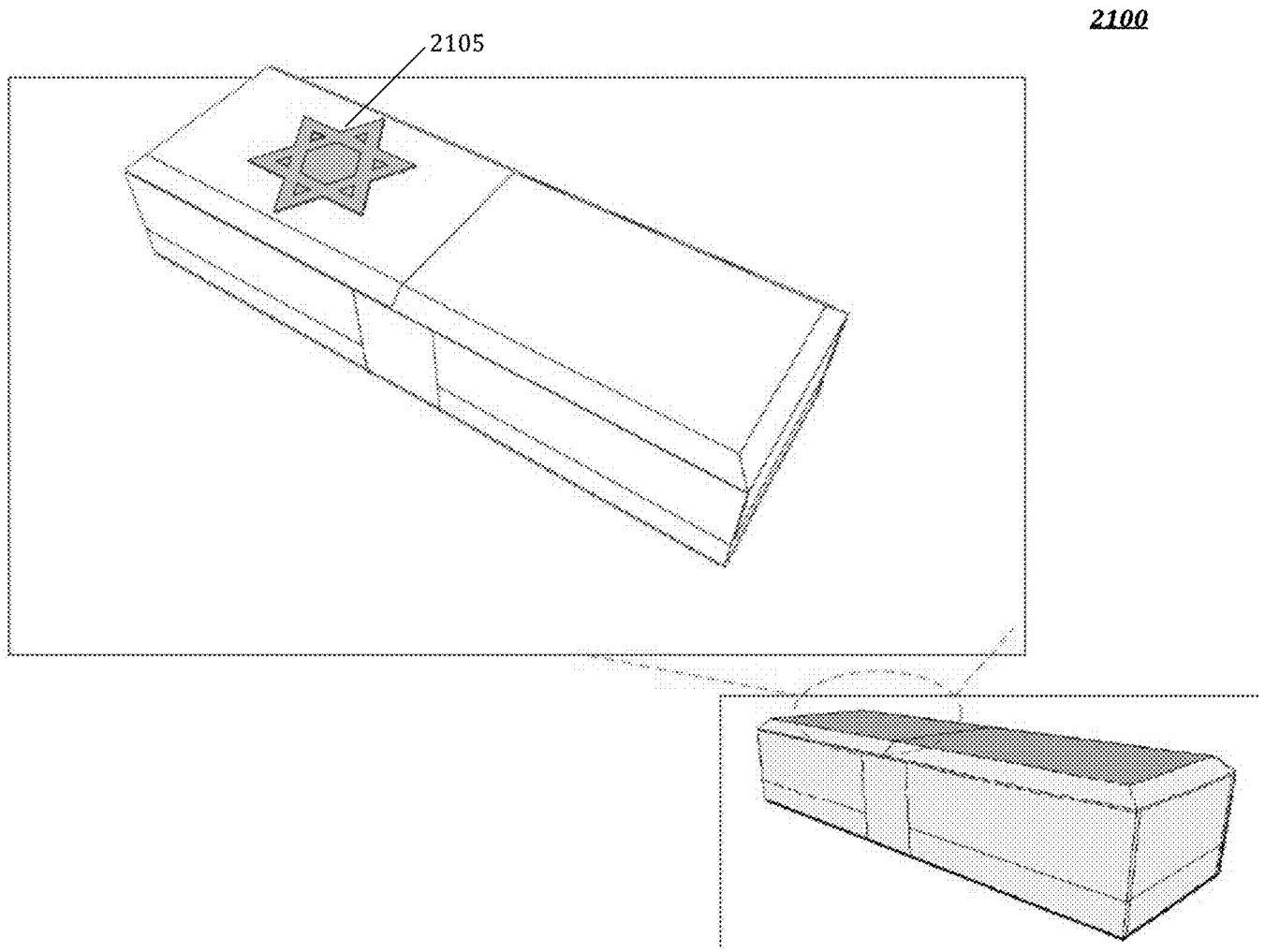
FIG. 21 illustrates a container comprising a Star of David.

Religious insignia (e.g. a crucifix, Star of David, Buddhist symbol, Khanda, Om, etc.) and naming characters may be affixed in or on the exterior shells or inside covers of the container for personalization. For example, FIG. 19 illustrates a container 1900 comprising a cross 1905; FIG. 20 illustrates a cross 2005 on container 2000; and FIG. 21 illustrates a Star of David 2105 on container 2100.

Figure 22:
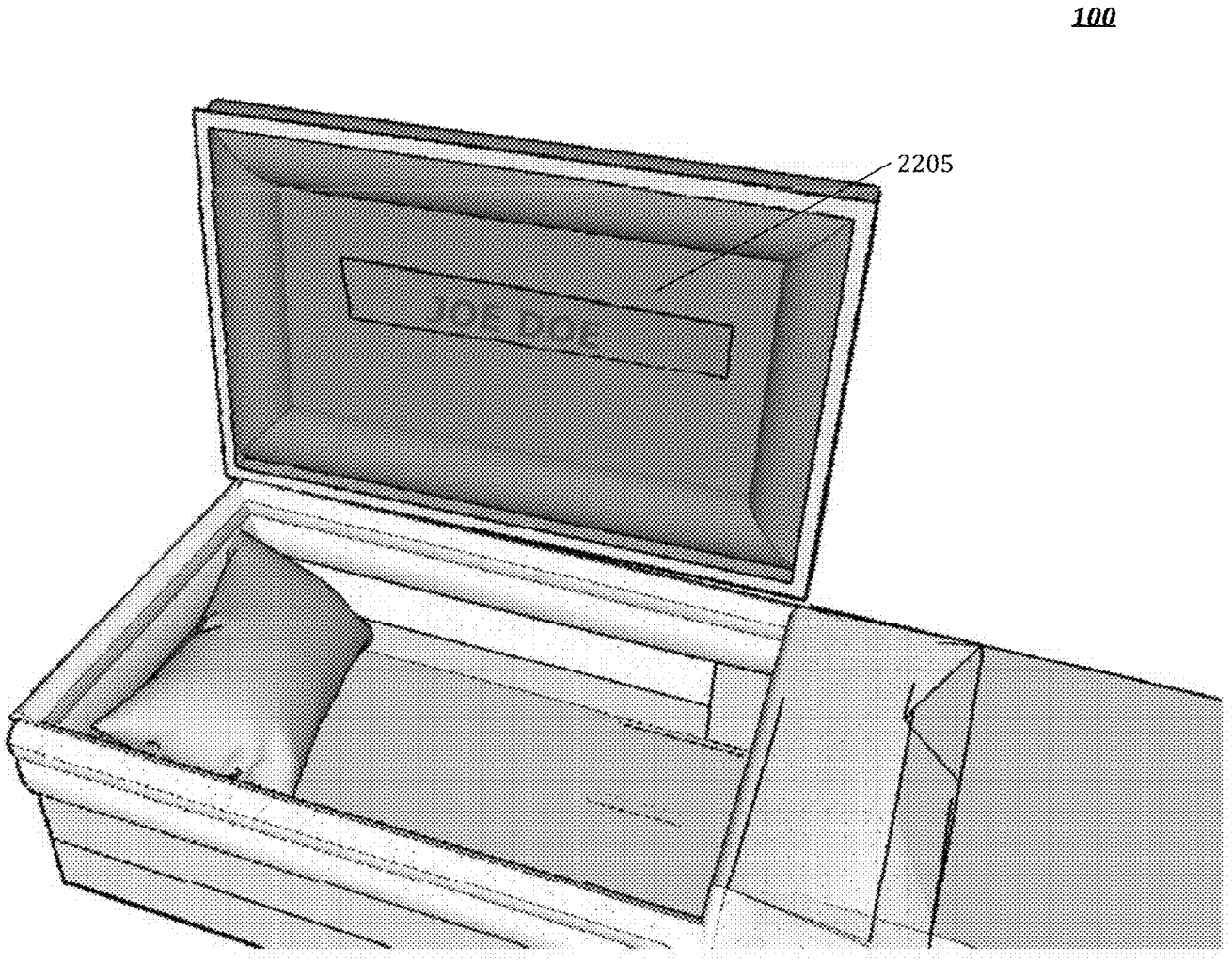
FIG. 22 illustrates a container with a name affixed.
Figure 23:
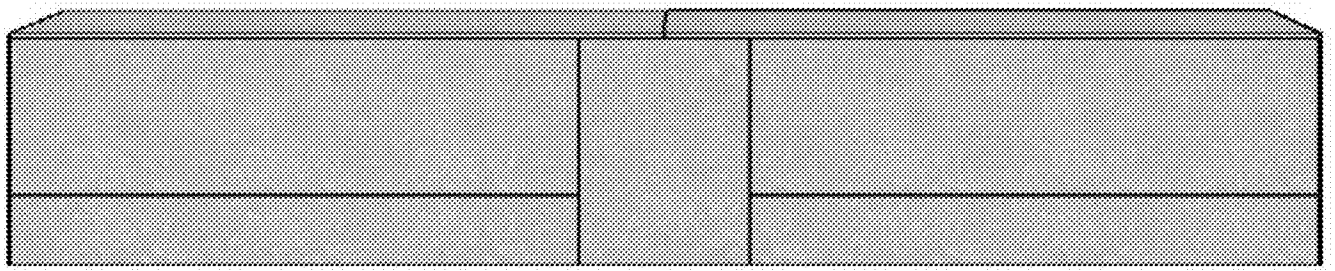
FIG. 23 illustrates a container comprising a veneer.

In some embodiments, the container may be personalized with a name. For example, FIG. 22 illustrates a container 2200 with a name 2205 affixed. The name may be affixed, for example, by stitching, screen printing, dying, or other means. In further embodiments, the container may be personalized with a veneer. FIG. 23 illustrates a container 2300 comprising a veneer.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A container comprising:

two base components;

a center locking device configured to be partially inserted within each of the two base components in order to mate the two base components;

a plurality of panels, each configured to attach to at least one of the two base components and at least two of the plurality of panels;

two cover sections configured to attach at least one of the plurality of panels, wherein the two cover sections each comprise at least one protrusion comprising a wide and a narrow end; and wherein the two cover sections are configured to attach to at least one of the plurality of panels by inserting the at least one protrusion into a wide slot and sliding the protrusion such that the protrusion is within a narrow slot.

2. The container of claim 1, wherein the two base components, the center-locking device, the plurality of panels, and two cover sections are combustible.

3. The container of claim 1, wherein the plurality of panels attach to the at least two of the plurality of panels via a tongue-and-groove connection.

4. The container of claim 3, wherein:

the tongue-and-groove connection comprises a tongue comprising a wide end and a narrow end, and wherein the tongue-and-groove connection comprises a groove comprising a wide groove end and a narrow groove end, such that when the tongue is inserted within the groove, the tongue can be removed along only one axis.

5. The container of claim 4, wherein the tongue is configured with a trapezoidal profile.

6. The container of claim 1, further comprising a veneer.

7. The container of claim 1, further comprising at least one of the following: a cross, a crucifix, a Star of David, a Buddhist symbol, a Khanda, and an Om.

8. The container of claim 1, wherein the container is configured to be disassembled and packed within a 38¼"×12¼"×24¼" box, and assembled into at least a 76"×24"×13" container.

9. The container of claim 1, further comprising a liner.

10. The container of claim 9, further comprising hook-and-loop for attaching the liner to an interior of the container.

11. The container of claim 1, further comprising a veneer attached to an exterior of the container.

12. The container of claim 1, wherein the container is configured to be assembled without the use of any tools.

13. A system comprising:

a container comprising:

two base components;

a center locking device configured to be partially inserted within each of the two base components in order to mate the two base components, a plurality of panels, each configured to attach to at least one of the two base components and at least two of the plurality of panels, and two cover sections, each comprising at least one bevel, configured to attach to at least one of the plurality of panels; and a box comprising at least one support;

wherein the at least one support is configured to mate with the at least one bevel of each of the two cover sections; and wherein the container is configured to be assembled without the use of any tools.

* * * * *